US009069325B2

(12) United States Patent
Kitamura

(10) Patent No.: US 9,069,325 B2
(45) Date of Patent: Jun. 30, 2015

(54) IMAGE FORMING APPARATUS

(71) Applicant: Oki Data Corporation, Tokyo (JP)

(72) Inventor: Makoto Kitamura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 56 days.

(21) Appl. No.: 14/018,968

(22) Filed: Sep. 5, 2013

(65) Prior Publication Data

US 2014/0072332 A1 Mar. 13, 2014

(30) Foreign Application Priority Data

Sep. 13, 2012 (JP) ..... 2012-201590

(51) Int. Cl.
*G03G 21/16* (2006.01)
*G03G 21/18* (2006.01)

(52) U.S. Cl.
CPC ..... *G03G 21/1633* (2013.01); *G03G 21/1619* (2013.01); *G03G 21/185* (2013.01)

(58) Field of Classification Search
CPC ..... G03G 21/1619; G03G 21/1623; G03G 21/1633
USPC ..... 399/110–114, 118
See application file for complete search history.

(56) References Cited

U.S. PATENT DOCUMENTS

| | | | | |
|---|---|---|---|---|
| 8,254,805 | B2 * | 8/2012 | Mizuno et al. | 399/111 |
| 8,666,280 | B2 * | 3/2014 | Mizuno et al. | 399/111 |
| 2006/0050135 | A1 * | 3/2006 | Fukuda | 347/138 |
| 2009/0028601 | A1 * | 1/2009 | Mizuno et al. | 399/111 |
| 2010/0080617 | A1 * | 4/2010 | Noguchi | 399/112 |
| 2011/0293324 | A1 * | 12/2011 | Hoashi | 399/112 |
| 2011/0299885 | A1 * | 12/2011 | Taba | 399/111 |
| 2012/0183318 | A1 * | 7/2012 | Sato et al. | 399/110 |
| 2012/0275823 | A1 * | 11/2012 | Mizuno et al. | 399/111 |

FOREIGN PATENT DOCUMENTS

| | | |
|---|---|---|
| JP | 2006-078542 A | 3/2006 |
| JP | 2008-310292 | 12/2008 |
| JP | 2010-102321 | 5/2010 |
| JP | 2011-253048 | 12/2011 |
| JP | 2012-145879 | 8/2012 |

* cited by examiner

*Primary Examiner* — David Gray
*Assistant Examiner* — Carla Therrien
(74) *Attorney, Agent, or Firm* — Rabin & Berdo, P.C.

(57) ABSTRACT

An image forming apparatus includes an apparatus main body, and a visible image forming unit that forms a developer image. The visible image forming unit includes a first unit, a second unit detachably mounted to the apparatus main body, and a third unit. An image forming apparatus further includes a first mechanism that causes the first unit and the second unit to move toward or away from each other, a moving member that moves the first mechanism, and a second mechanism that causes the second unit and the third unit to move toward or away from each other in conjunction with a movement of the first mechanism.

20 Claims, 27 Drawing Sheets

IMAGE FORMING APPARATUS

BACKGROUND OF THE INVENTION

The present invention relates to an image forming apparatus using electrophotographic technology.

Image forming apparatuses such as a copier, a facsimile machine or a printer using electrophotographic technology are widely used. Such an image forming apparatus performs a charging process to uniformly charge a surface of an image bearing body such as a photosensitive drum, an exposure process to expose the surface of the image bearing body with light to form a latent image, a developing process to develop the latent image using a developer to form a developer image on the image bearing body, a transfer process to transfer the developer image to a medium such as a paper, and a fixing process to fix the developer image to the medium.

Recently, there has been developed an image forming apparatus including a process unit and an apparatus main body to which the process unit is detachably mounted. The process unit includes several units for performing the above described processes (for example, the image bearing body, a charging unit that performs the charging process, and a developing unit that performs the developing process). The process unit can be easily detached or replaced, for example, when operation failure of the image forming apparatus occurs or when maintenance of the image forming apparatus is to be performed. An example of such an image forming apparatus is disclosed in, for example, Japanese Laid-open Patent Publication No. 2006-78542 (see FIG. 3 and paragraphs 0014-0016).

The image forming apparatus disclosed in the above described publication includes an apparatus main body, a process unit (i.e., a process cartridge) detachably mounted to the apparatus main body, a cover member rotatably provided on the apparatus main body, and an optical head mounted on an inner side of the cover member. When the cover member is in a position to close an upper part of the apparatus main body, a light emitting surface of the optical head faces a surface of a photosensitive drum (i.e., the image bearing body) provided in the process unit. When detaching the process unit from the apparatus main body, the cover member is rotated so as to open the upper part of the apparatus main body, and then the process unit is taken out from the apparatus main body. In other words, the process unit is configured as a replaceable unit.

However, in the conventional image forming apparatus, operability in detaching or replacing the replaceable unit (i.e., the process unit) is not sufficient.

SUMMARY OF THE INVENTION

An aspect of the present invention is intended to provide an image forming apparatus capable of enhancing operability in detaching or replacing a replaceable unit.

According to an aspect of the present invention, there is provided an image forming apparatus including an apparatus main body, and a visible image forming unit that forms a developer image. The visible image forming unit includes a first unit, a second unit detachably mounted to the apparatus main body, and a third unit. The image forming apparatus further includes a first mechanism that causes the first unit and the second unit to move closer to or away from each other, a moving member that moves the first mechanism, and a second mechanism that causes the second unit and the third unit to move closer to or away from each other in synchronization with a movement of the first mechanism.

With such a configuration, operability in detaching or replacing a replaceable unit can be enhanced.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Figure 1:
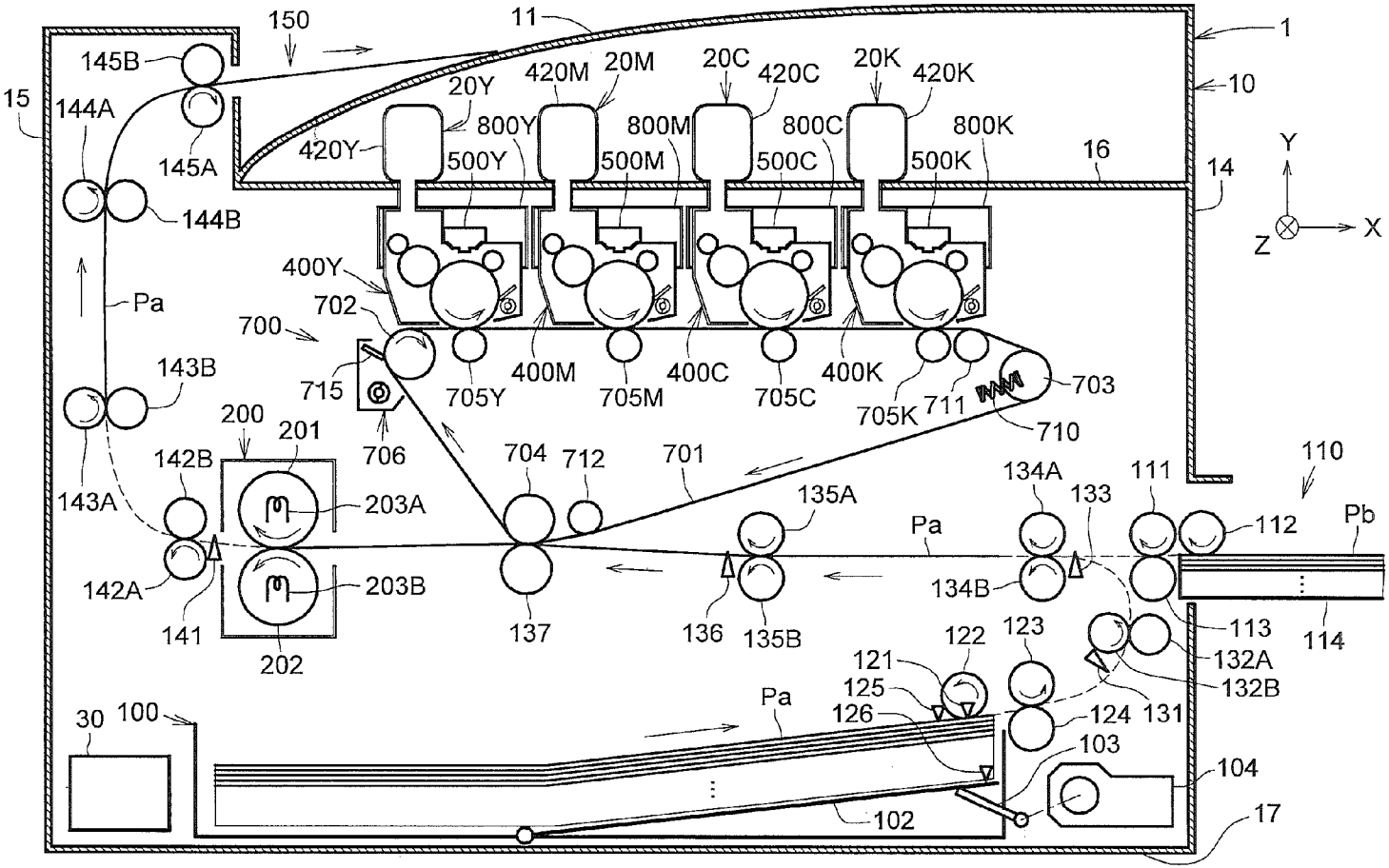
FIG. 1 is a schematic view showing a configuration of an image forming apparatus according to the first embodiment of the present invention.

Hereinafter, embodiments of the present invention will be described with reference to drawings. The drawings are provided for illustrative purpose and are not intended to limit the scope of the present invention. In the drawings, identical components are assigned with the same reference numerals.

First Embodiment

FIG. 1 is a schematic view showing a configuration of an image forming apparatus 1 according to the first embodiment of the present invention. The image forming apparatus 1 uses electrophotographic technology, and is configured to transfer a developer image to a recording medium using an intermediate transfer method. The intermediate transfer method is a method forming a developer image on an image bearing body (for example, a photosensitive drum), primarily transferring the developer image to an intermediate transfer belt, and secondarily transferring the developer image to the recording medium.

As shown in FIG. 1, the image forming apparatus 1 includes an apparatus main body (i.e., a frame) 10, a tray 100, an MPT (i.e., a multi-purpose tray) 110, image forming units 20K, 20C, 20M and 20Y, an intermediate transfer belt unit 700, a secondary transfer roller 137 (i.e., a secondary transfer portion), a fixing unit 200, and a control unit 30.

The tray 100 is configured to store a stack of recording media Pa in the form of sheets. The MPT 110 is configured to store a stack of recording media Pb in the form of sheets. The image forming units 20K, 20C, 20Y and 20M are configured to form developer images (i.e., toner images) of different colors. The intermediate transfer belt unit 700 is configured to carry the developer image to the secondary transfer portion. The secondary transfer roller 137 is configured to transfer the developer image from an intermediate transfer belt 701 to the printing medium Pa (Pb). The fixing unit 200 is configured to fix the developer image to the recording medium Pa (Pb). The control unit 30 controls an entire operation of the image forming apparatus 1. The recording media Pa and Pb are sheet-like medium such as a paper, a synthesized paper, a thick paper, a special paper, a plastic film, or a fabric. However, the recording media Pa and Pb are not limited to them.

The tray 100 is detachably mounted to the apparatus main body 10. The tray 100 includes a medium placing portion 102 and a lift-up lever 103. The lift-up lever 103 is rotatably supported about a shaft portion. The stack of the recording media Pa is placed on the medium placing portion 102. The lift-up lever 103 is disconnectably connected to a driving motor 104 provided in the apparatus main body 10. When the tray 100 is mounted to the apparatus main body 10, the control unit 30 detects that the tray 100 is mounted, and activates the driving motor 104. The lift-up lever 103 is rotated by a rotational driving force transmitted from the driving motor 104, and a tip of the lift-up lever 103 abuts against a bottom of the medium placing portion 102, so that the lift-up lever 103 pushes the medium placing portion 102 upward. As the media Pa placed on the medium placing portion 102 moves upward, the uppermost recording medium Pa contacts a pickup roller 122. An upward movement sensor 121 detects that the uppermost recording medium Pa reaches the pickup roller 122, and outputs detection signal to the control unit 30. When the control unit 30 receives the detection signal sent from the upward movement sensor 121, the control unit 30 stops the driving motor 104. A medium detection sensor 125 and a remaining amount detection sensor 126 are provided in the vicinity of the pickup roller 122. The medium detection sensor 125 is used for detecting a presence or absence of the recording medium Pa. The remaining amount detection sensor 126 is used for detecting a remaining amount of the recording medium Pa. The control unit 30 can detect the presence or absence of the recording medium Pa in the tray 100 based on an output from the medium detection sensor 125. Further, the control unit 30 can detect the remaining amount of the recording medium Pa in the tray 100 based on an output from the remaining amount detection sensor 125.

The pickup roller 122 is driven by a rotational driving force transmitted from a driving motor (not shown), and rotates counterclockwise to feed the recording medium Pa out of the tray 100. The pickup roller 122 has a one-way clutch mechanism therein that transmits a rotational driving force in only one direction, and is rotatable in a direction shown by an arrow (counterclockwise) even when the rotational driving force is not given. The recording medium Pa fed out from the tray 100 is supplied to a nip portion between the feed roller 123 and the retard roller 124 (i.e., a portion where the feed roller 123 and the retard roller 124 are pressed against each other). The feed roller 123 is driven by a rotational driving force transmitted from a driving motor (not shown), and rotates counterclockwise as shown by an arrow. The feed roller 123 and the retard roller 124 feed each recording medium Pa into a conveying path. The retard roller 124 rotates following the rotation of the feed roller 123, and generates a torque in a direction opposite to a feeding direction of the recording medium Pa. Therefore, even when a plurality of the recording media Pa are fed out of the tray 100, the feed roller 123 and the retard roller 124 separate the recording media Pa from each other, and feed each recording medium Pa into the conveying path. The feed roller 123 has a one-way clutch mechanism therein, and is rotatable in a direction shown by an arrow (counterclockwise) even when the rotational driving force is not given.

A first medium sensor 131, a pair of conveying rollers 132A and 132B, a second medium sensor 133, a pair of conveying rollers 134A and 134B, a pair of conveying rollers 135A and 135B, and a third medium sensor 136 are provided downstream of the feed roller 123 along the conveying path of the recording medium Pa. The conveying rollers 132A, 132B, 134A, 134B, 135A and 135B are driven by rotational driving forces transmitted from a conveyance driving motor (not shown) and respectively rotate in directions shown by arrows to convey the medium Pa. Further, the conveying rollers 132A and 132B have a mechanism to prevent a skew (i.e., an inclination of the recording medium Pa with respect to the conveying direction) of the recording medium Pa.

The medium sensors 131, 133 and 136 are configured to detect passage of the recording medium Pa in a contact manner or a non-contact manner. The control unit 30 controls timing to start rotating the conveying rollers 132A and 132B based on detection signal outputted by the first medium sensor 131, and controls timing to start rotating the conveying rollers 134A and 134B based on detection signal outputted by the second medium sensor 133. The third medium sensor 136 (i.e., a writing sensor) is disposed between the conveying rollers 135A and 135B and the secondary transfer roller 137. The control unit 30 controls, for example, operations timings of the image forming units 20K, 20C, 20M and 20Y and a driving speed of the intermediate transfer belt 701 based on detection signal outputted from the third medium sensor 136.

The MPT 110 is detachably mounted to the apparatus main body 10. The MPT 110 includes a medium placing portion 114 for placing a plurality of sheet-like recording media Pb thereon. For example, the recording media Pb of an irregular size or relatively thick recording media Pb are placed on the medium placing portion 114. A pickup roller 112, a feed roller 111 and a retard roller 113 are provided in the vicinity of a tip of the medium placing portion 114. The feed roller 111 and the retard roller 113 constitute a pair of rollers facing each other. The pickup roller 112 is driven by a rotational driving force transmitted from a driving roller (not shown), and rotates clockwise as shown by an arrow to feed the recording medium Pb from the MPT 110. The recording medium Pb fed out from the MPT 110 is supplied to a nip portion between the feed roller 111 and the retard roller 113 (i.e., a portion where the feed roller 111 and the retard roller 113 are pressed against each other). The feed roller 111 is driven by a rotational driving force transmitted from a driving roller (not shown), and rotates clockwise as shown by an arrow. The feed roller 111 and the retard roller 113 feed each recording medium Pb into a conveying path. The retard roller 113 rotates following a rotation of the feed roller 111, and generates a torque in a direction opposite to a feeding direction of the recording medium Pb. Therefore, even when a plurality of the recording media Pb are fed out of the MPT 110, the feed roller 111 and the retard roller 113 separate the recording media Pb from each other, and feed each recording medium Pb toward the conveying rollers 134A and 134B.

Figure 2:
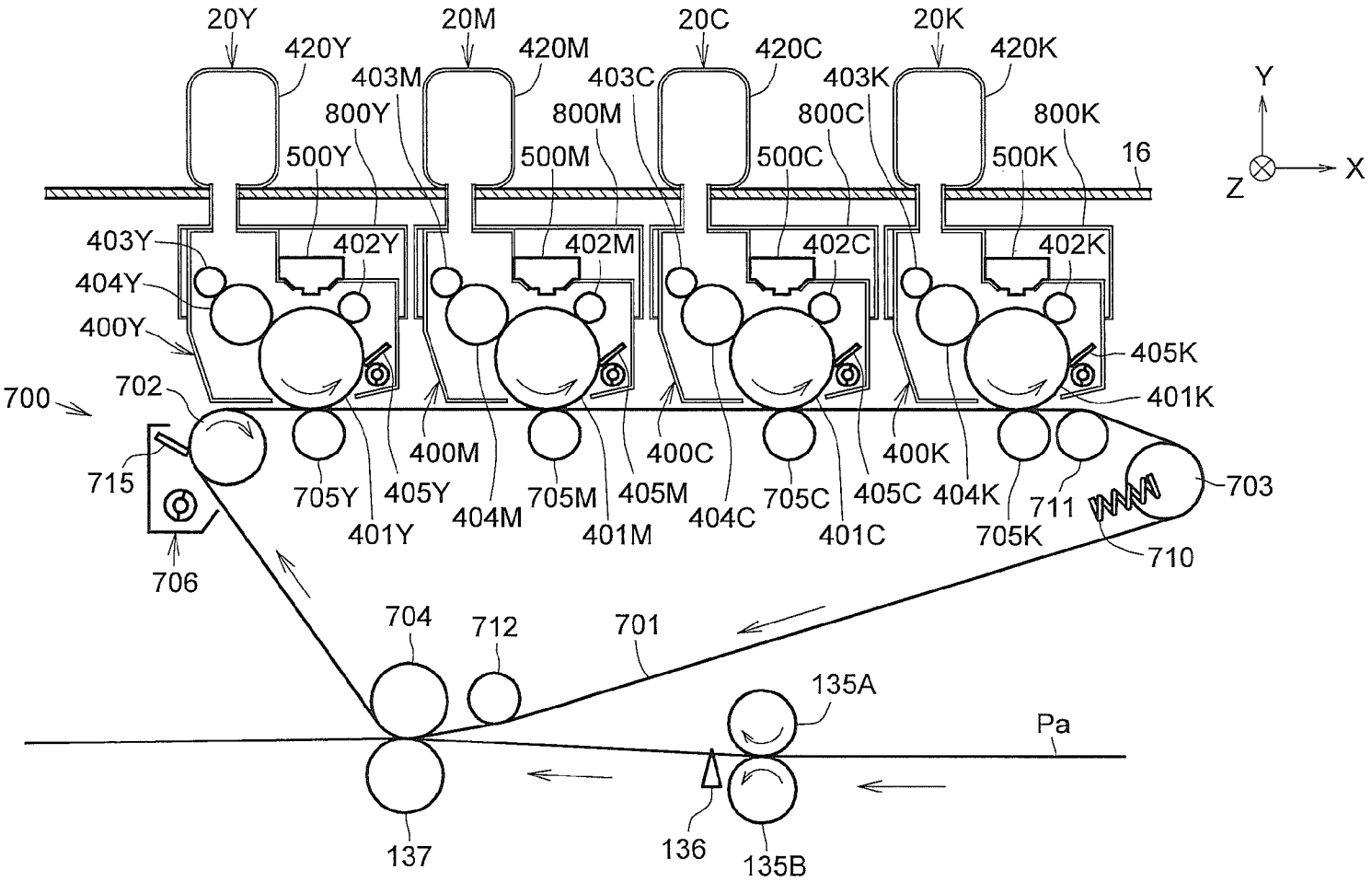
FIG. 2 is a schematic view showing a configuration of an image forming unit and an intermediate transfer belt unit according to the first embodiment.

FIG. 2 is a schematic view showing the image forming units 20K, 20C, 20M and 20Y and the intermediate transfer belt unit 700 according to the first embodiment. The intermediate transfer belt unit 700 is also referred to as a first unit (or a transfer unit).

The intermediate transfer belt unit 700 includes an intermediate transfer belt 701 as an intermediate transfer body, a driving roller 702 for driving the intermediate transfer belt 701, a tension roller 703 as a driven roller, a resilient member 710 that biases the tension roller 703 in a predetermined direction, a backup roller 704, auxiliary rollers 711 and 712, primary rollers 705K, 705C, 705M and 705Y, and a belt cleaning unit 706. The driving roller 702, the tension roller 703, the backup roller 704 and the auxiliary rollers 711 and 712 are supported so as to be rotatable about respective rotation axes extending in a direction (i.e., Z direction) perpendicular to the plane of FIG. 2.

The intermediate transfer belt 701 is an endless belt made of, for example, resin material such as polyimide resin. The intermediate transfer belt 701 is stretched around the driving roller 702, the tension roller 703, the backup roller 704 and the auxiliary rollers 711 and 712. The driving roller 702 is driven by a rotational driving force transmitted from a driving motor (not shown) and rotates clockwise to move (rotate) the intermediate transfer belt 701. The resilient member 710 is made of, for example, a coil spring. The resilient member 710 biases the tension roller 703 to apply a suitable tension to an entire body of the intermediate transfer belt 701, so as to reduce fluctuation of the tension of the intermediate transfer belt 701. The driving roller 702, the tension roller 703 and the resilient member 710 constitute a driving mechanism for driving the intermediate transfer belt 701.

The image forming units 20K, 20C, 20M and 20Y are configured to form images (i.e., developer images) formed by developer (for example, powder toner) of black (K), cyan (C), magenta (M) and yellow (Y). The black image forming unit 20K includes a developer storage unit 420K storing black developer, a process unit 400K detachably held by a unit holding portion 800K, and an exposure unit 500K. The developer storage unit 420K is placed on a top plate 16 that constitutes a part of the apparatus main body (i.e., the frame) 10. The developer storage body 420K supplies the black developer to the process unit 400K through a through-hole formed on the top plate 16 and a developer supply hole formed on the unit holding portion 800K.

The process unit 400K includes a photosensitive drum 401K as an image bearing body, a charging roller 402K that uniformly charges a surface of the photosensitive drum 401K, a developing roller 404K as a developer bearing body (i.e., a developing portion), a supply roller 403K, and a drum cleaning portion 405K. The supply roller 403K supplies the developer (supplied from the developer storage body 420K) to a surface of the developing roller 404K. The drum cleaning portion 405K scrapes the developer remaining on the surface of photosensitive drum 401K after the primary transfer of the developer image. The photosensitive drum 401K has a cylindrical shape. The photosensitive drum 401K is driven by a rotational driving force transmitted from a drum motor (not shown) and rotates counterclockwise as shown by an arrow. The photosensitive drum 401K includes a metal pipe (i.e., a conductive supporting body) made of aluminum and a photoconductive layer formed on the metal pipe and made of organic photoconductor (OPC) of the like. The process unit 400K also has a developing blade (not shown) for regulating a thickness of a developer layer (i.e., a toner layer) on the surface of the developing roller 404K.

The exposure unit 500K is disposed in the vicinity of the photosensitive drum 401K so as to face the surface of the photosensitive drum 401K. The exposure unit 500K includes a plurality of LED (Light Emitting Diode) elements arranged along an axial direction of the photosensitive drum 401K (i.e., Z direction), an LED driving circuit for driving the LED elements, and a lens array for introducing light emitted by the LED elements to the surface of the photosensitive drum 401K.

The exposure unit 500K is driven by the control unit 30 to emit light according to a print image so as to expose the surface of the photosensitive drum 401K. With the exposure, a latent image is formed on the surface of the photosensitive drum 401K. When the latent image on the surface of the photosensitive drum 401K reaches a position facing the developing roller 404K, the black developer moves to the latent image due to an electric potential difference between the latent image on the surface of the photosensitive drum 401K and the developing roller 404K, and a developer image (i.e. a toner image) is formed on the surface of the photosensitive drum 401K. According to the rotation of the photosensitive drum 401K, the developer image on the photosensitive drum 401K moves to a primary transfer position. At the primary transfer position, the intermediate transfer belt 701 is nipped (sandwiched) between the photosensitive drum 401K and the primary transfer roller 705K. The developer image is transferred from the photosensitive drum 401K to the intermediate transfer belt 701 by a transfer voltage is applied to the primary transfer roller 705K.

The configurations of the image forming units 20C, 20M and 20Y are substantially the same as that of the image forming unit 20K except the developer.

That is, the cyan image forming unit 20C includes a developer storage unit 420C storing a cyan developer, a process unit 400C detachably held by a unit holding portion 800C, and an exposure unit 500C. The developer storage unit 420C is placed on the top plate 16 of the apparatus main body 10. The developer storage body 420C supplies the cyan developer to the process unit 400C through a through-hole formed on the top plate 16 and a developer supply hole formed on the unit holding portion 800C. The process unit 400C includes a photosensitive drum 401C as an image bearing body, a charging roller 402C that uniformly charges a surface of the photosensitive drum 401C, a developing roller 404C as a developer bearing body (i.e., a developing portion), a supply roller 403C, and a drum cleaning portion 405C. The supply roller 403C supplies the developer (supplied from the developer storage body 420C) to a surface of the developing roller 404C. The drum cleaning portion 405C scrapes the developer remaining on the surface of photosensitive drum 401C after the primary transfer of the developer image.

The magenta image forming unit 20M includes a developer storage unit 420M storing a magenta developer, a process unit 400M detachably held by a unit holding portion 800M, and an exposure unit 500M. The developer storage unit 420M is placed on the top plate 16 of the apparatus main body 10. The developer storage body 420M supplies the magenta developer to the process unit 400M through a through-hole formed on the top plate 16 and a developer supply hole formed on the unit holding portion 800M. The process unit 400M includes a photosensitive drum 401M as an image bearing body, a charging roller 402M that uniformly charges a surface of the photosensitive drum 401M, a developing roller 404M as a developer bearing body (i.e., a developing portion), a supply roller 403M, and a drum cleaning portion 405M. The supply roller 403M supplies the developer (supplied from the developer storage body 420M) to a surface of the developing roller 404M. The drum cleaning portion 405M scrapes the developer remaining on the surface of photosensitive drum 401M after the primary transfer of the developer image.

The yellow image forming unit 20Y includes a developer storage unit 420Y for storing a yellow developer, a process unit 400Y detachably held by a unit holding portion 800Y, and an exposure unit 500Y. The developer storage unit 420Y is placed on the top plate 16 of the apparatus main body 10. The developer storage body 420Y supplies the yellow developer to the process unit 400Y through a through-hole formed on the top plate 16 and a developer supply hole formed on the unit holding portion 800Y. The process unit 400Y includes a photosensitive drum 401Y as an image bearing body, a charging roller 402Y that uniformly charges a surface of the photosensitive drum 401Y, a developing roller 404Y as a developer bearing body (i.e., developing portion), a supply roller 403Y, and a drum cleaning portion 405Y. The supply roller 403Y supplies the developer (supplied from the developer storage body 420Y) to a surface of the developing roller 404Y. The drum cleaning portion 405Y scrapes the developer remaining on the surface of photosensitive drum 401Y after the primary transfer of the developer image.

In this regard, each of the process units 400K, 400C, 400M and 400Y is also referred to as a second unit. Each of the exposure units 500K, 500C, 500M and 500Y is also referred to as a third unit. The intermediate transfer belt unit 700 (i.e., the first unit), the process units 400K, 400C, 400M and 400Y (i.e., the second unit), the exposure units 500K, 500C, 500M and 500Y (i.e., the third unit) constitute a visible image forming unit.

The process units 400K, 400C, 400M and 400Y are arranged in a moving direction of the intermediate transfer belt 701 (i.e., in X direction). Four developer images formed by the process units 400K, 400C, 400M and 400Y are transferred to the surface of the intermediate transfer belt 701 in an overlapping manner, and a color developer image is formed on the intermediate transfer belt 701. The intermediate transfer belt 701 bears the developer image (i.e., the color develop image) on the surface thereof, and carries the developer image to a secondary transfer position between the backup roller 704 and the secondary transfer roller 137.

The backup roller 704 and the secondary transfer roller 137 constitute a secondary transfer portion for transferring the developer image to the recording medium Pa (Pb). The backup roller 704 and the secondary transfer roller 137 are disposed so as to face each other, and nip the intermediate transfer belt 701 therebetween. The secondary transfer roller 137 can be formed of, for example, a metal core and a resilient layer (for example, a foamed rubber layer) formed on the surface of the metal core.

The belt cleaning portion 706 is configured to remove a residual developer remaining on the surface of the intermediate transfer belt 701 after the secondary transfer of the developer image. The belt cleaning portion 706 has a cleaning member 715 which is pressed against the surface of the intermediate transfer belt 701 with a constant pressure. The cleaning member 715 scrapes the residual developer (having been carried from the secondary transfer portion) from the intermediate transfer belt 701.

Referring back to FIG. 1, the fixing unit 200 has a function to fix the color developer image to the recording medium Pa (Pb) conveyed from the secondary transfer portion. The fixing unit 200 includes an upper roller 201 that has a cylindrical shape and rotates clockwise, and a lower roller 202 that has a cylindrical shape and rotates counterclockwise. The upper roller 201 and the lower roller 202 face each other. A heat source 203A such as a halogen lamp is provided in the upper roller 201. A heat source 203B such as a halogen lamp is provided in the lower roller 202. Each of the upper roller 201 and the lower roller 202 has a surface layer made of resilient material. The upper roller 201 and the lower roller 202 nip the medium Pa (Pb) therebetween, and apply heat and pressure to the recording medium Pa (Pb). With the application of heat and pressure, the color developer image is molten and fixed to the recording medium Pa (Pb).

The recording medium Pa (Pb) ejected from the fixing unit 200 is ejected by the ejection rollers 142A, 142B, 143A, 143B, 144A, 144B, 145A and 145B, and is placed on a stacker portion 150 outside the apparatus main body 10. The image forming apparatus further includes driving elements (not shown) such as a stepping motor for rotating the ejection rollers 142A, 142B, 143A, 143B, 144A, 144B, 145A and 145B. The control unit 30 control operations of the driving elements.

A configuration of the image forming apparatus 1 will be described in detail.

Figure 3:
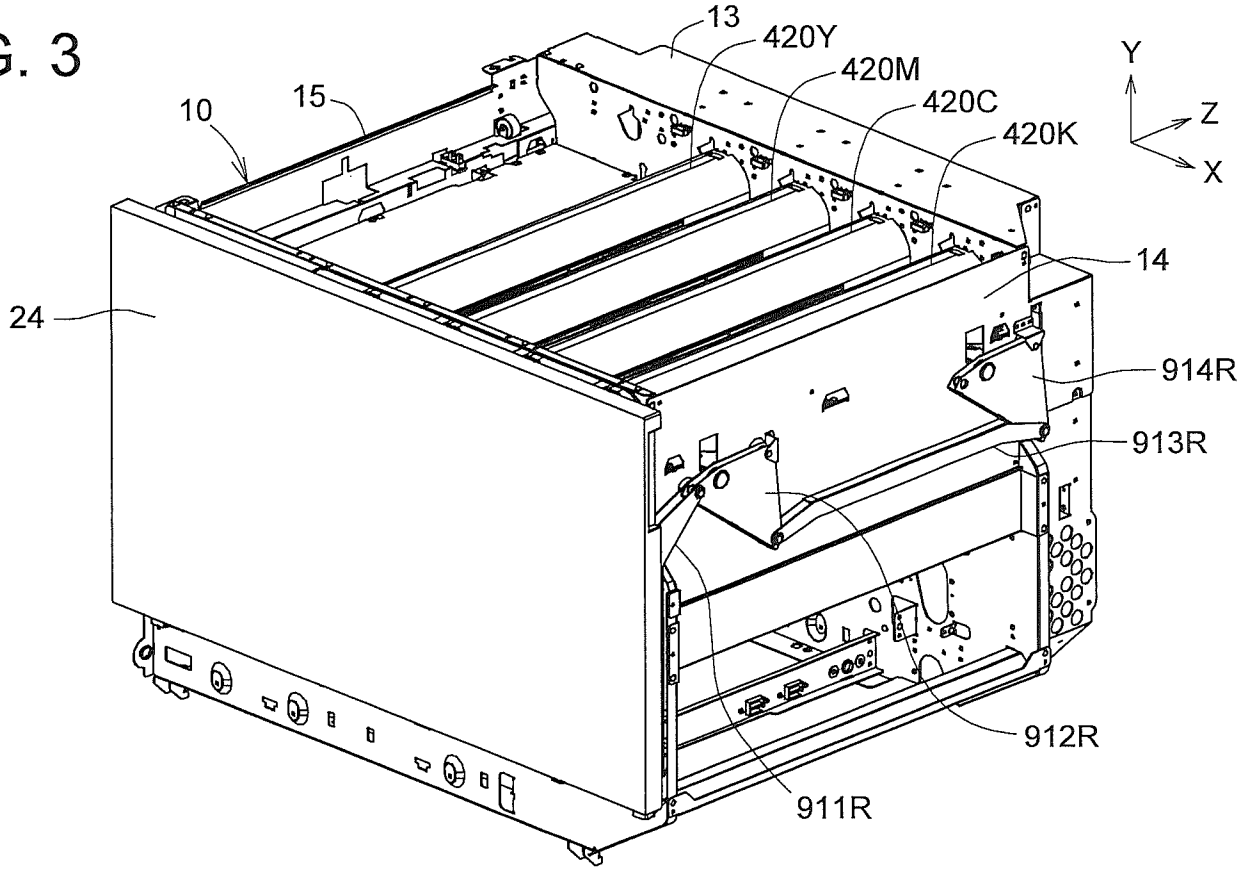
FIG. 3 is a perspective view showing the image forming apparatus in a state where a front cover portion is in a closing position.
Figure 4:
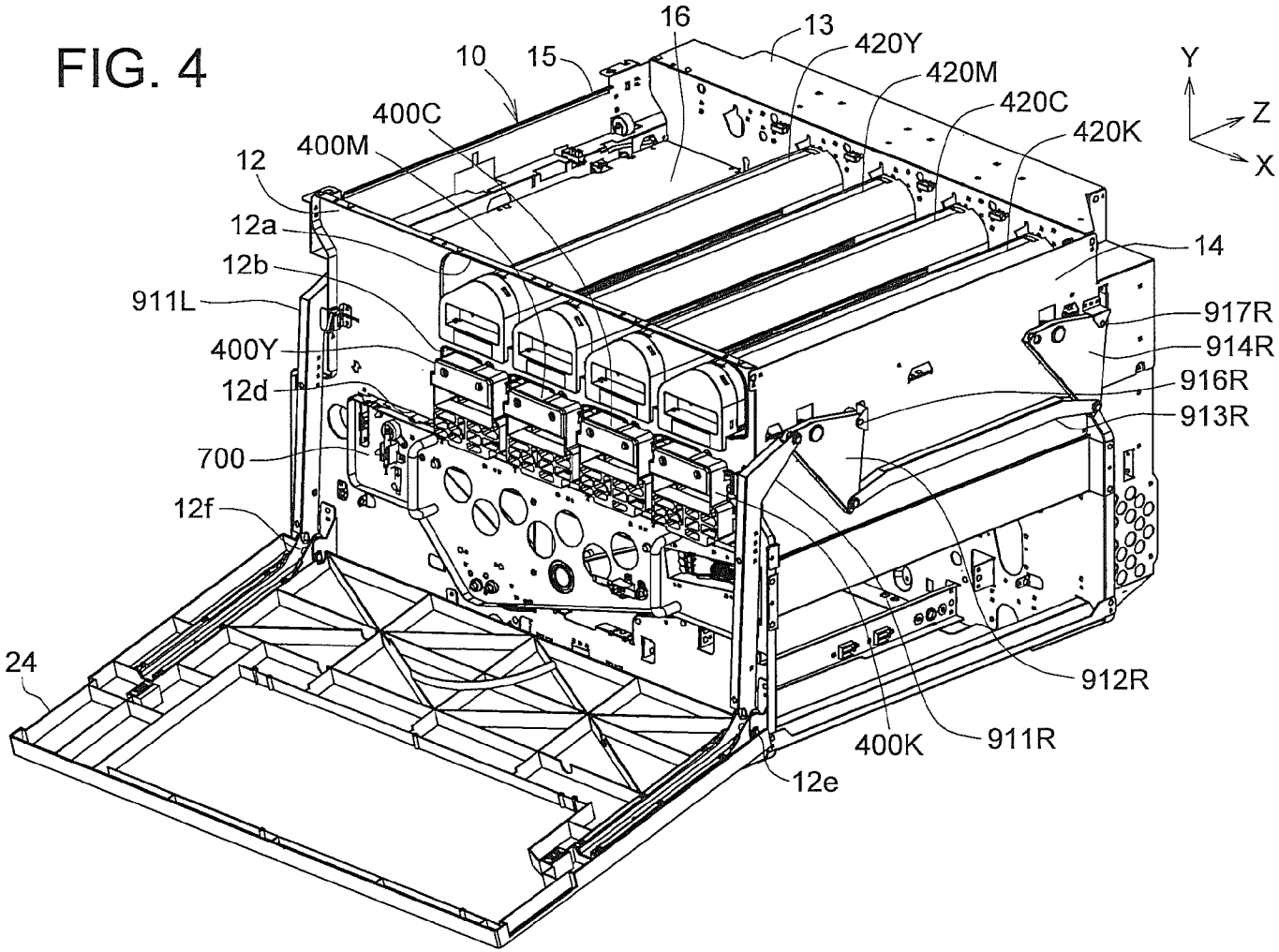
FIG. 4 is a perspective view showing the image forming apparatus in a state where the front cover portion is in an opening position.
Figures 5A, 5B, 5C:
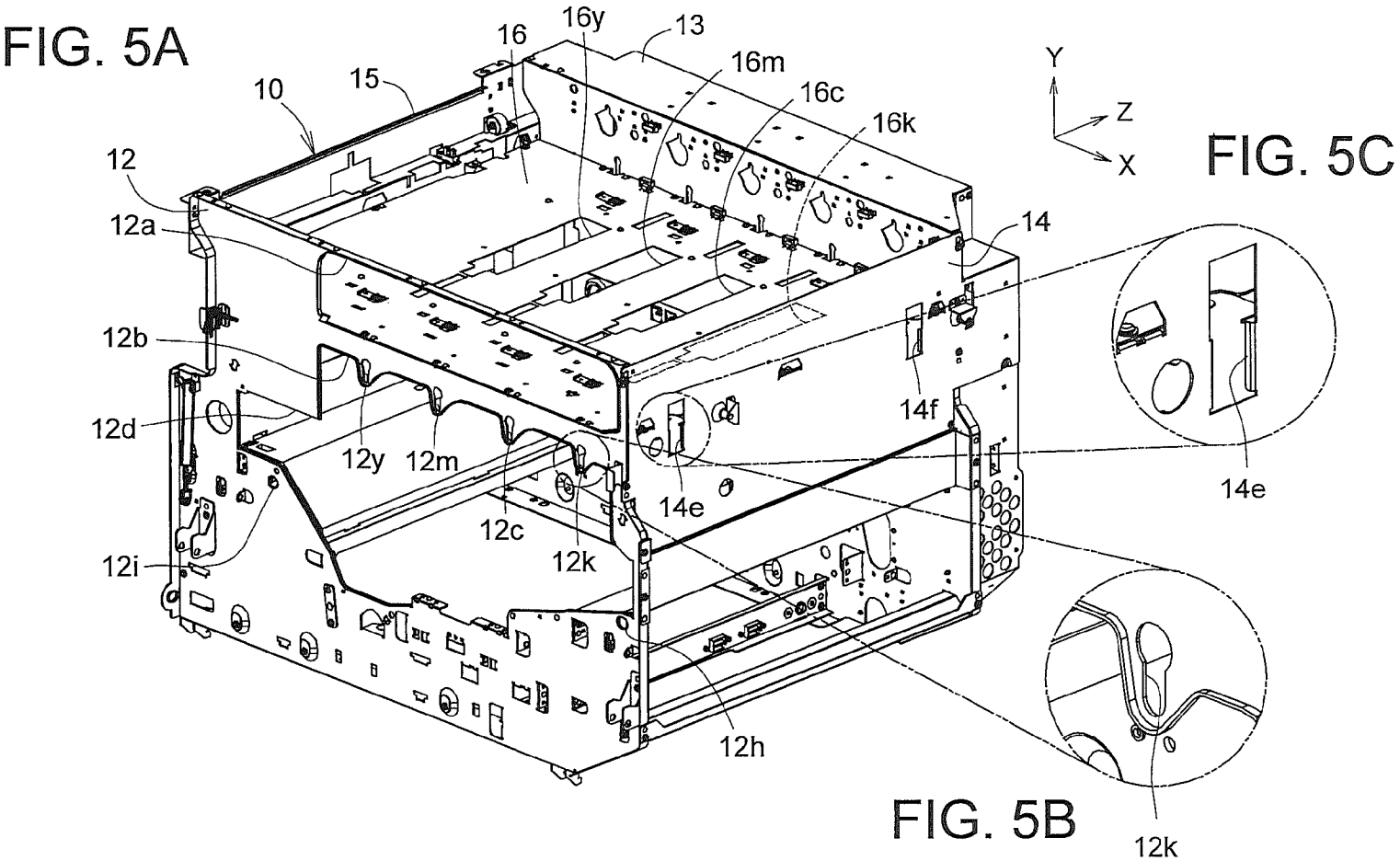
FIG. 5A is a perspective view showing a main body (i.e., a frame) of the image forming apparatus according to the first embodiment.
FIGS. 5B and 5C are enlarged views showing parts of the image forming apparatus according to the first embodiment.

FIGS. 3 and 4 are perspective views showing a main part of the image forming apparatus 1 having a front cover portion 24 according to the first embodiment. FIG. 3 shows a state where the front cover portion 24 is in a closing position. FIG. 4 shows a state where the front cover portion 24 is in an opening position. FIG. 5A is a perspective view showing a configuration of the apparatus main body 10 (i.e., the frame) of the image forming apparatus 1. FIGS. 5B and 5C are enlarged views of parts of the apparatus main body 10. In FIGS. 3, 4 and 5A, the top plate 11 (FIG. 1) is omitted for convenience of illustration.

As shown in FIG. 5A, the apparatus main body 10 includes a front plate 12 that constitutes a front surface of the apparatus main body 10, a rear plate 13 that constitutes a rear surface of the apparatus main body 10, a right side plate 14 that constitutes a right side surface of the apparatus main body 10, a left side plate 15 that constitutes a left side surface of the apparatus main body 10, and the top plate 16. The plates 12 through 16 are formed of metal or resin.

The front plate 12 has three front openings 12*a*, 12*b* and 12*d*. The front opening 12*a* allows the developer storage units (i.e., developer cartridges) 420K, 420C, 420M and 420Y to be respectively taken out from the apparatus main body 10 in −Z direction, and to be inserted into the apparatus main body 10 in +Z direction. The developer storage units 420K, 420C, 420M and 420Y are respectively mounted to mounting holes 16*k*, 16*c*, 16*m* and 16*y* (FIG. 5) of the top plate 16.

The front opening 12*b* allows the process units (i.e., the developer cartridges) 400K, 400C, 400M and 400Y to be respectively taken out from the apparatus main body 10 in −Z direction, and to be inserted into the apparatus main body 10 in +Z direction.

The front opening 12*d* (i.e., the lowest opening of the front openings 12*a*, 12*b* and 12*d*) allows the intermediate transfer belt unit 700 to be taken out from the apparatus main body in −Z direction, and to be inserted into the apparatus main body 10 in +Z direction. FIG. 4 shows a state where the developer storage units 420K, 420C, 420M and 420Y and the process units 400K, 400C, 400M and 400Y and the intermediate transfer belt unit 700 are mounted in the apparatus main body 10.

As shown in FIG. 4, the front cover portion 24 (i.e., a moving member) is rotatably supported by supporting portions 12*e* and 12*f* provided at a lower end of the front plate 12. FIG. 3 shows a state where the front cover portion 24 is in a position to close the front openings 12*a*, 12*b* and 12*d* (i.e., the closing position). FIG. 4 shows a state where the front cover portion 24 is in a position to open the front openings 12*a*, 12*b* and 12*d* (i.e., the opening position).

Figure 6:
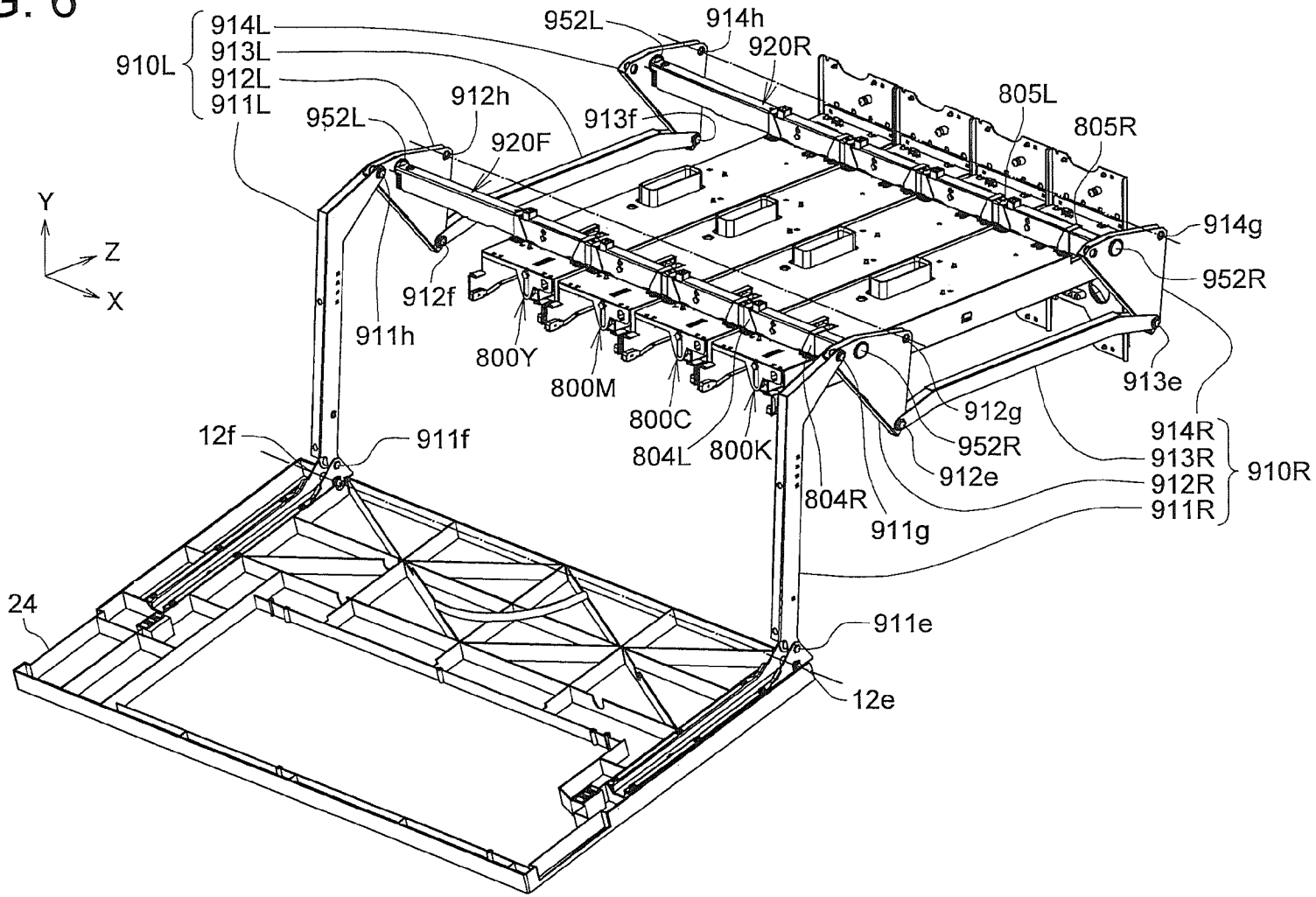
FIG. 6 is a perspective view showing an example of a linking mechanism for linking a unit holding portion and the front cover portion.

The process units 400K, 400C, 400M and 400Y are detachably mounted to the respective unit holding portions 800K, 800C, 800M and 800Y (FIG. 2) provided in the apparatus main body 10. The image forming apparatus 1 of the first embodiment includes a mechanism for linking the unit holding portions 800K, 800C, 800M and 800Y and the front cover portion 24. FIG. 6 is a perspective view showing linking mechanisms (i.e., linking members) 910R and 910L configured to link the unit holding portions 800K, 800C, 800M and 800Y and the front cover portion 24. In FIG. 6, the apparatus main body 10, the developer storage units 420K, 420C, 420M and 420Y, the process units 400K, 400C, 400M and 400Y and the intermediate transfer belt unit 700 are omitted.

The linking mechanism 910R is provided in the vicinity of the right side plate 14. As shown in FIG. 6, the linking mechanism 910R includes an arm member 911R, a lever member 912R, a driven lever member 914R and a lever-linking member 913R. An end portion of the arm member 911R is rotatably connected to an end portion of the front cover portion 24 at a connecting portion 911*e*. The other end portion of the arm member 911R is rotatably connected to the lever member 912R at a connecting portion 911*g*. The lever member 912R is rotatably connected to a supporting portion 912*g* provided on the right side plate 14 (not shown in FIG. 6). To be more specific, the lever member 912R is rotatably mounted to the right side plate 14 via a mounting element 916R as shown in FIG. 4. The lever member 912R is rotatable about the supporting portion 912*g* of the apparatus main body 10.

The driven lever member 914R is rotatably connected to a supporting portion 914*g* provided on the right side plate 14 (not shown in FIG. 6). To be more specific, the driven lever member 914R is rotatably mounted to the right side plate 14 via a mounting element 917R as shown in FIG. 4. The driven lever member 914R is rotatable about the supporting portion 914*g* of the apparatus main body 10.

The lever-linking member 913R is configured to link the lever member 912R and the driven lever member 914R. The lever-linking member 913R has a function to transmit compression force or tension force from the lever member 912R to the driven lever member 914R. An end portion of the lever-linking member 913R is rotatably connected to an end portion of the lever member 912R at a connecting portion 912*e*. The other end portion of the lever-linking member 913R is rotatably connected to an end portion of the driven lever member 914R at a connecting portion 913*e*. Therefore, the driven lever member 914R moves is conjunction with the lever member 912R. For example, when the lever member 912R rotates clockwise about the supporting portion 912*g*, the driven lever member 914R rotates clockwise about the supporting portion 914*g*. When the lever member 912R rotates counterclockwise about the supporting portion 912*g*, the driven lever member 914R rotates counterclockwise about the supporting portion 914*g*.

The linking mechanism 910L is provided in the vicinity of the left side plate 15. As shown in FIG. 6, the linking mechanism 910L includes an arm member 911L, a lever member 912L, a driven lever member 914L and a lever-linking member 913L. An end portion of the arm member 911L is rotatably connected to an end portion of the front cover portion 24 at a connecting portion 911*f*. The other end portion of the arm member 911L is rotatably connected to the lever member 912L at a connecting portion 911*h*. The lever member 912L is rotatably connected to a supporting portion 912*h* of the left side plate 15 (not shown in FIG. 6). The lever member 912L is rotatable about the supporting portion 912*h*. The driven lever member 914L is rotatably connected to a supporting portion 914*h* of the left side plate 15 (not shown in FIG. 6). The driven lever member 914L is rotatable about the supporting portion 914*h* of the apparatus main body 10.

The lever-linking member 913L is configured to link the lever member 912L and the driven lever member 914L. The lever-linking member 913L has a function to transmit compression force or tension force from the lever member 912L to the driven lever member 914L. An end portion of the lever-linking member 913L is rotatably connected to an end portion of the lever member 912L at a connecting portion 912*f*. The other end portion of the lever-linking member 913L is rotatably connected to an end portion of the driven lever member 914L at a connecting portion 913*f*. Therefore, the driven lever member 914L moves in conjunction with the lever member 912L. For example, when the lever member 912L rotates clockwise about the supporting portion 912*h*, the driven lever member 914L rotates clockwise about the supporting portion 914*h*. When the lever member 912L rotates counterclockwise about the supporting portion 912*h*, the driven lever member 914L rotates counterclockwise about the supporting portion 914*h*.

A front beam unit 920F extending in X direction has end portions that are mounted to the lever members 912R and 912L. To be more specific, a cap member 952R provided at an end of the front beam unit 920F engages a through-hole (i.e., a support hole) of the right lever member 912R. A cap member 952L provided at the other end of the front beam unit 920F engages a through-hole (i.e., a support hole) of the left lever member 912L. Therefore, the lever members 912R and 912L rotatably support the cap members 952R and 952L of the front beam unit 920F.

A rear beam unit 920R extending in X direction has end portions that are mounted to the driven lever members 914R and 914L. To be more specific, a cap member 952R provided at an end of the rear beam unit 920R engages a through-hole (i.e., a support hole) of the right driven lever member 914R. A cap member 952L provided at the other end of the rear beam unit 920R engages a through-hole (i.e., a support hole) of the left driven lever member 914L. Therefore, the driven lever members 914R and 914L rotatably support the cap members 952R and 952L of the rear beam unit 920R.

Further, the front beam unit 920F supports front portions of the unit holding portions 800K, 800C, 800M and 800Y in a suspending manner. The rear beam unit 920R supports rear portions of the unit holding portions 800K, 800C, 800M and 800Y in a suspending manner.

Figure 7A:
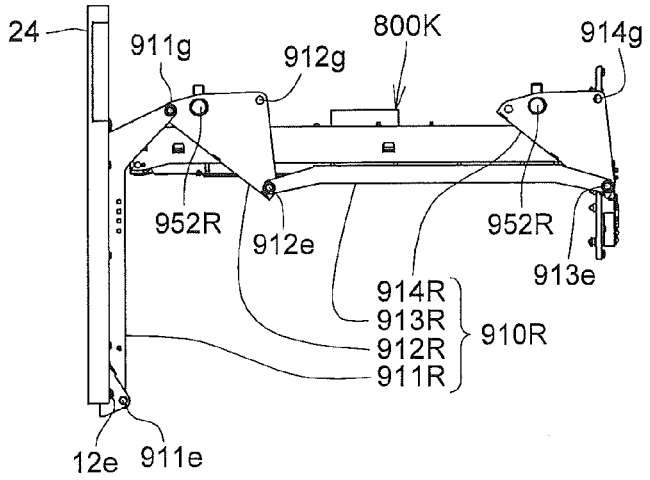
FIG. 7A is a right-side view showing the linking mechanism in a state where the front cover portion is in the closing position.
Figure 7B:
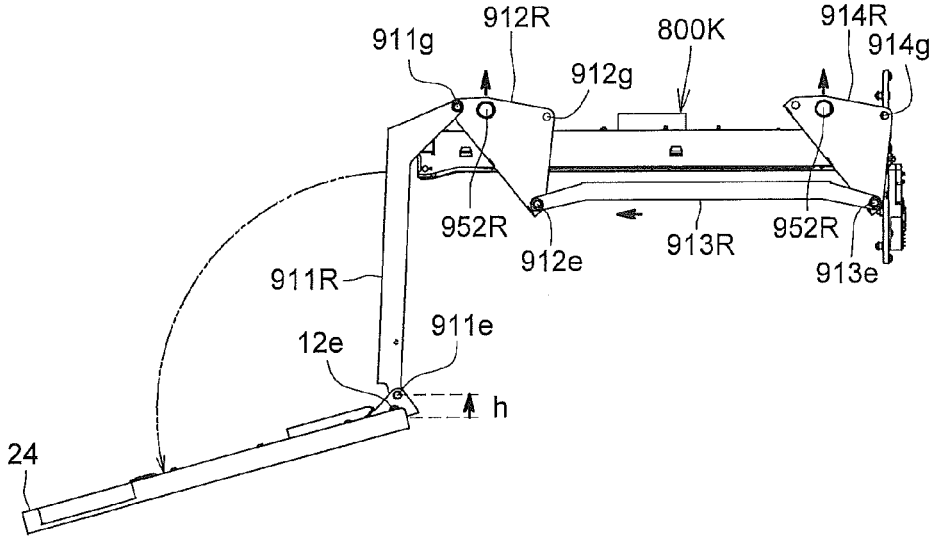
FIG. 7B is a right-side view showing the linking mechanism in a state where the front cover portion is in the opening position.

The linking mechanisms 910R and 910L cause the unit holding portions 800K, 800C, 800M and 800Y to move upward (in +Y direction) in conjunction with a rotational operation (i.e., an opening operation) of the front cover portion 24 from the closing position (FIG. 3) to the opening position (FIG. 4). FIG. 7A is a right side view showing the linking mechanism 910R when the front cover portion 24 is in the closing position. FIG. 7B is a right side view showing the linking mechanism 910R when the front cover portion 24 is in the opening position.

When the front cover portion 24 rotates from the closing position (i.e., a first position) shown in FIG. 7A to the opening position (i.e., a second position) shown in FIG. 7B, the connecting portion 911*e* (between the arm member 911R and the front cover member 24) rotates counterclockwise about the supporting portion 12*e* in conjunction with the opening operation of the front cover portion 24, and moves upward by a height h. In this state, a force causing the front cover portion 24 to rotate is exerted on the connecting portion 911*e* via the supporting portion 12*e* according to principle of leverage. Therefore, as the front cover portion 24 rotates from the closing position to the opening position, the arm member 911R pushes the end of the lever member 912R upward via the connecting portion 911*g*. In this state, the lever member 912R rotates clockwise about the supporting portion 912*g*. Further, a force pushing the end of the lever member 912R upward is exerted on the cap member 952R via the supporting portion 912*g* according to principle of leverage.

According to the same principle, in the left linking mechanism 910L, as the front cover portion 24 rotates from the closing position to the opening position, a force pushing the end of the lever member 912L upward is exerted on the cap member 952L via the supporting portion 912*h*. Therefore, as the front cover portion 24 rotates from the closing position toward the opening position, the lever members 912R and 912L cause the front beam unit 920R to move upward.

Similarly, the driven lever members 914R and 914L respectively rotate about the supporting portions 914*g* and 914*h* in conjunction with the lever members 912R and 912L, and cause the rear beam unit 920R to move upward. Accordingly, the unit holding portions 800K, 800C, 800M and 800Y move in a direction away from the intermediate transfer belt unit 700 (FIG. 4) in conjunction with the opening operation of the front cover portion 24.

In this way, the linking mechanisms 910R and 910L cause the unit holding portions 800K, 800C, 800M and 800Y to move in a direction away from the intermediate transfer unit belt unit 700 in conjunction with the opening operation of the front cover portion 24.

The process units 400K, 400C, 400M and 400Y are respectively mounted to the unit holding portions 800K, 800C, 800M and 800Y. Therefore, when the front cover portion 24 rotates from the opening position to the closing position, the linking mechanism 910R and 910L (and the beam units 920F and 920R) cause the process units 400K, 400C, 400M and 400Y to move away from the intermediate transfer belt unit 700 in conjunction with the opening operation of the front cover portion 24. In contrast, when the front cover portion 24 rotates from the opening position to the closing position, the linking mechanisms 910R and 910L (and the beam units 920F and 920R) cause the process units 400K, 400C, 400M and 400Y to move toward the intermediate transfer belt unit 700 in conjunction with the closing operation of the front cover portion 24. In this regard, the linking mechanisms 910R and 910L and the beam units 920F and 920R constitute a first mechanism that causes the intermediate transfer belt unit 700 and the process units 400K, 400C, 400M and 400Y to move toward or away from each other.

Figure 8:
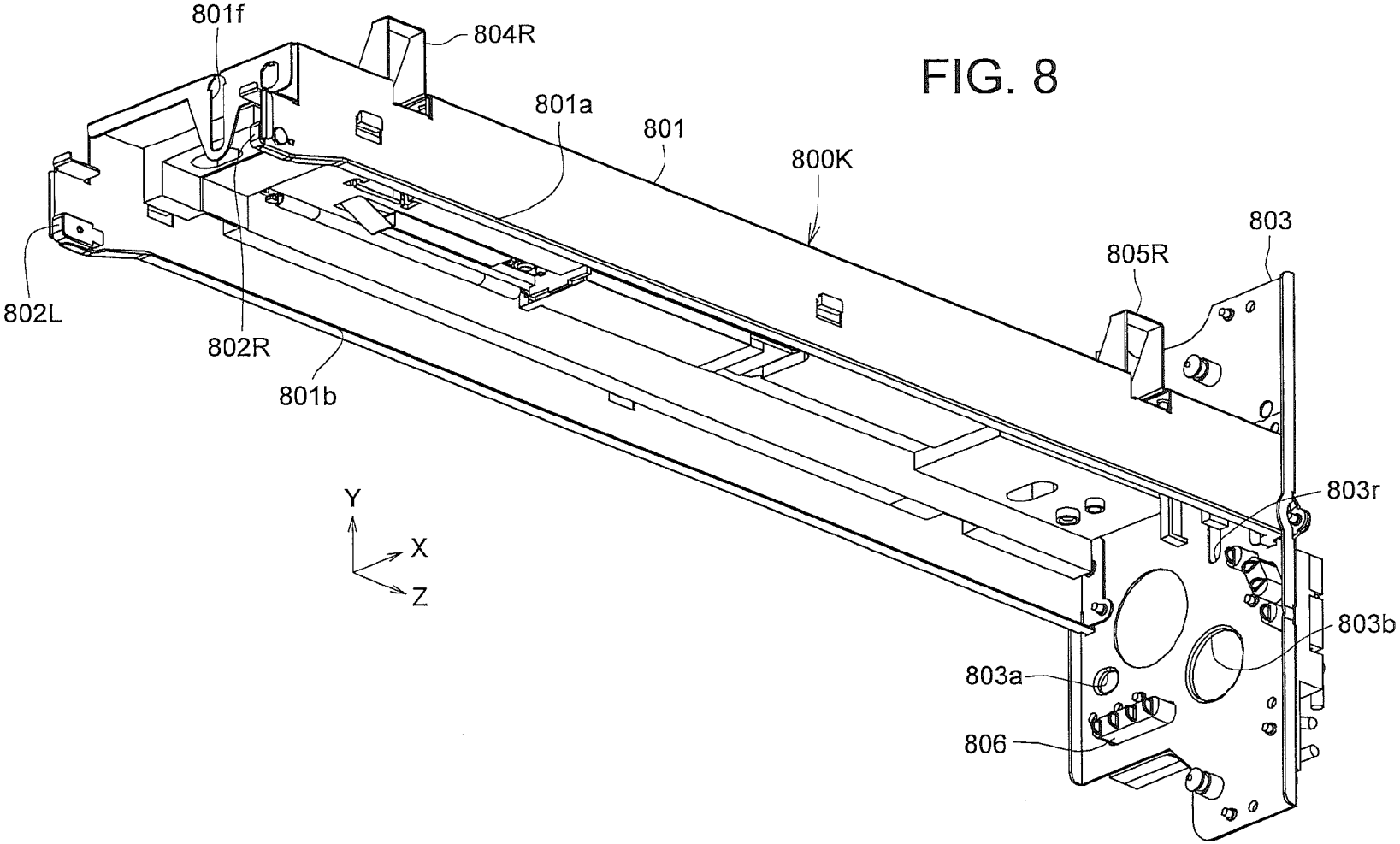
FIG. 8 is a bottom front perspective view showing an external configuration of the unit holding portion.
Figure 9:
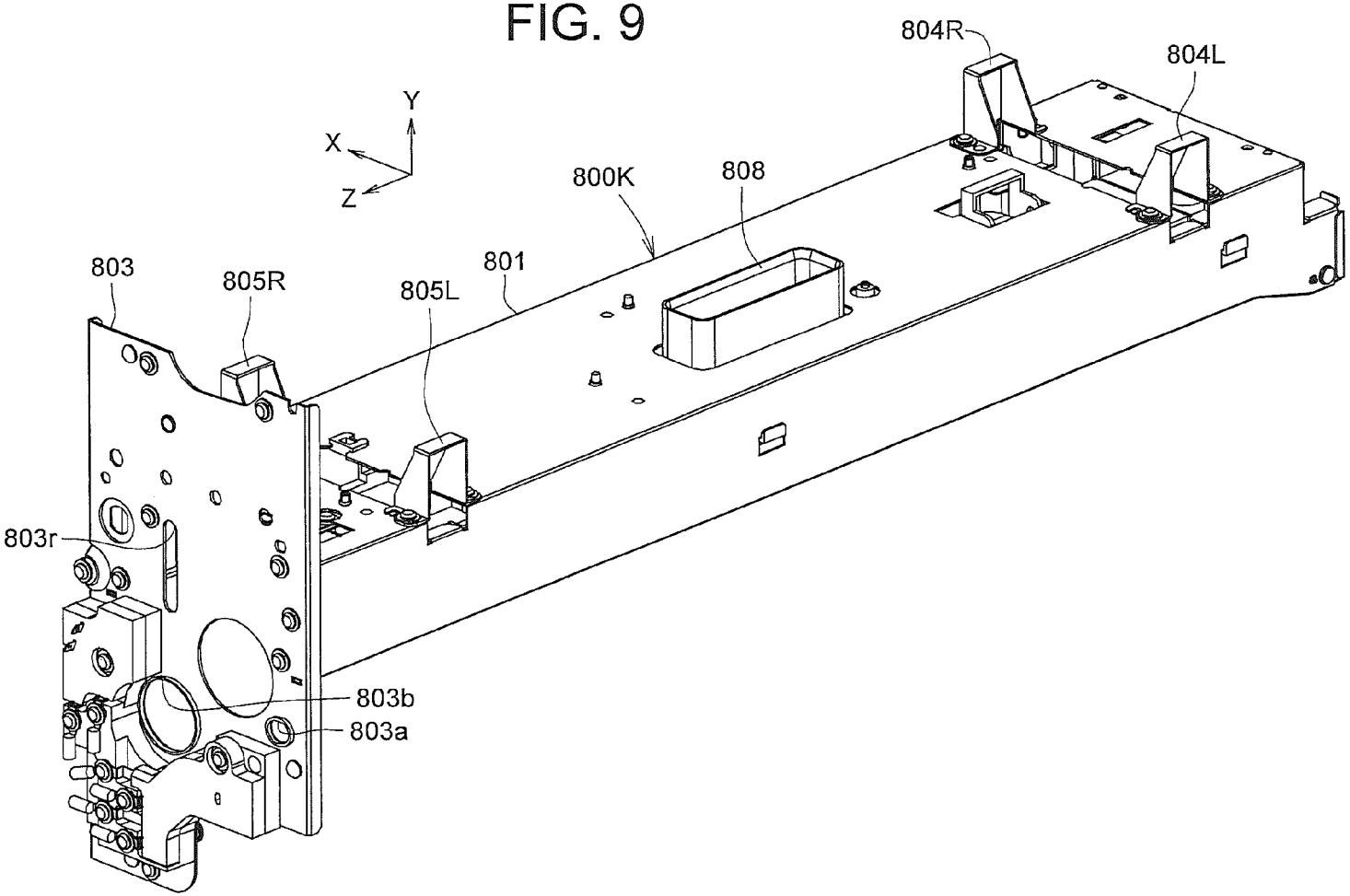
FIG. 9 is a top rear perspective view showing the external configuration of the unit holding portion.

Next, configurations of the unit holding portions 800K, 800C, 800M and 800Y will be described in detail. FIGS. 8 and 9 are perspective views showing the unit holding portion 800K for mounting the black process unit 400K. More specifically, FIG. 8 is a bottom front perspective view showing the unit holding portion 800K. FIG. 9 is a top rear perspective view showing the unit holding portion 800K. The unit holding portion 800K is formed of metal material and resin material. The other unit holding portions 800C, 800M and 800Y have the same configuration as the unit holding portion 800K.

As shown in FIG. 8, the unit holding portion 800K includes a main body 801 and a rear plate 803 connected to a rear end of the main body 801. Guide portions (i.e., guide rails) 801*a* and 801*b* are formed on the main body 801. The guide portions 801*a* and 801*b* are in the form of rails, and extend from a front end to the rear end of the main body 801. Lock pieces 802R and 802L are mounted to front ends of the guiding portions 801*a* and 801*b*. To-be-guided portions (in the form of rails) of the process unit 400K are detachably mounted to the guide portions 801*a* and 801*b* as described later.

As shown in FIG. 9, the main body 801 of the unit holding portion 800K has a developer supply opening 808. The developer supply opening 808 is formed at a center portion of the main body 801. Protrusions (i.e., hooks) 804R, 804L, 805R and 805L are fixed to the many body 801. The protrusions 804R, 804L, 805R and 805L are used to suspend the unit holding portion 800K from the beam units 920F and 920R (FIG. 6). As shown in FIG. 6, the front beam unit 920F is inserted into through-holes of the protrusions 804R and 804L on a front side. The rear beam unit 920R is inserted into through-holes of the protrusions 805R and 805L on a rear side.

As shown in FIGS. 8 and 9, an elongated hole 803*r* (i.e., a to-be engaged hole) is formed on the rear plate 803 of the unit holding portion 800K. The elongated hole 803*r* is elongated in Y direction. Further, an elongated hole 801*f* (FIG. 8) is formed on a front end surface of the main body 801. The elongated hole 801*f* is elongated in Y direction. The elongated hole 803*r* and the elongated hole 801*f* are provided for restricting positions of the exposure unit 500K in X direction and Y direction.

Further, the rear plate 803 has insertion holes 803*a* and 803*b* substantially in the form of circles. The through-holes 803*a* engages a positioning pin 411 (FIG. 11) of the process unit 400K. The through-holes 803*b* receives a sleeve 410 (FIG. 11) of the process unit 400K. As shown in FIG. 8, a connection terminal 806 is formed on an inner surface of the rear plate 803. The connection terminal 806 is biased in −Z direction by a biasing member (not shown) such as a coil spring. The connection terminal 806 contacts and is electrically connected to an electric contact 413 (FIG. 11) as described later.

Figure 10:
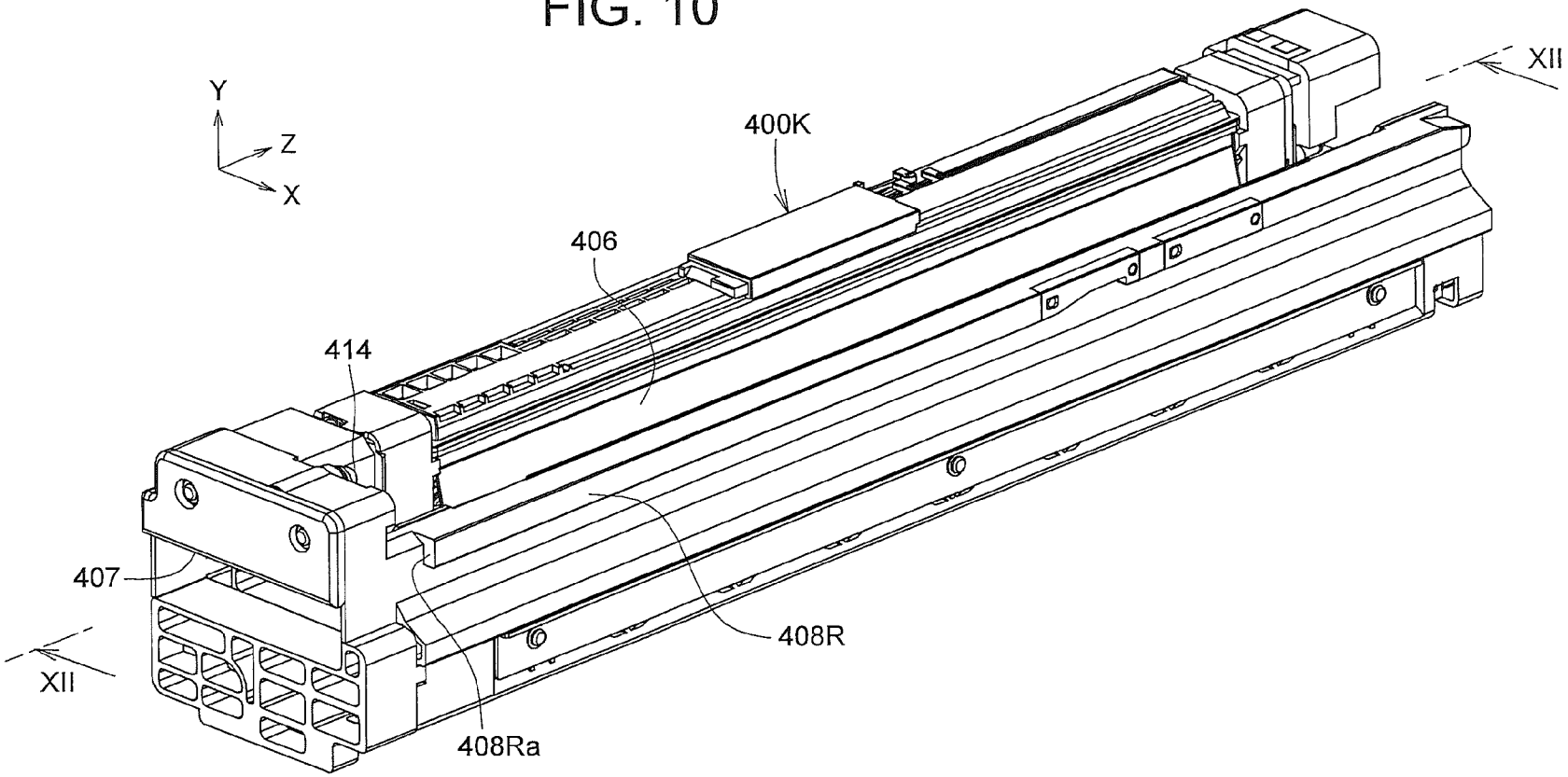
FIG. 10 is a top front perspective view showing the process unit.
Figure 11:
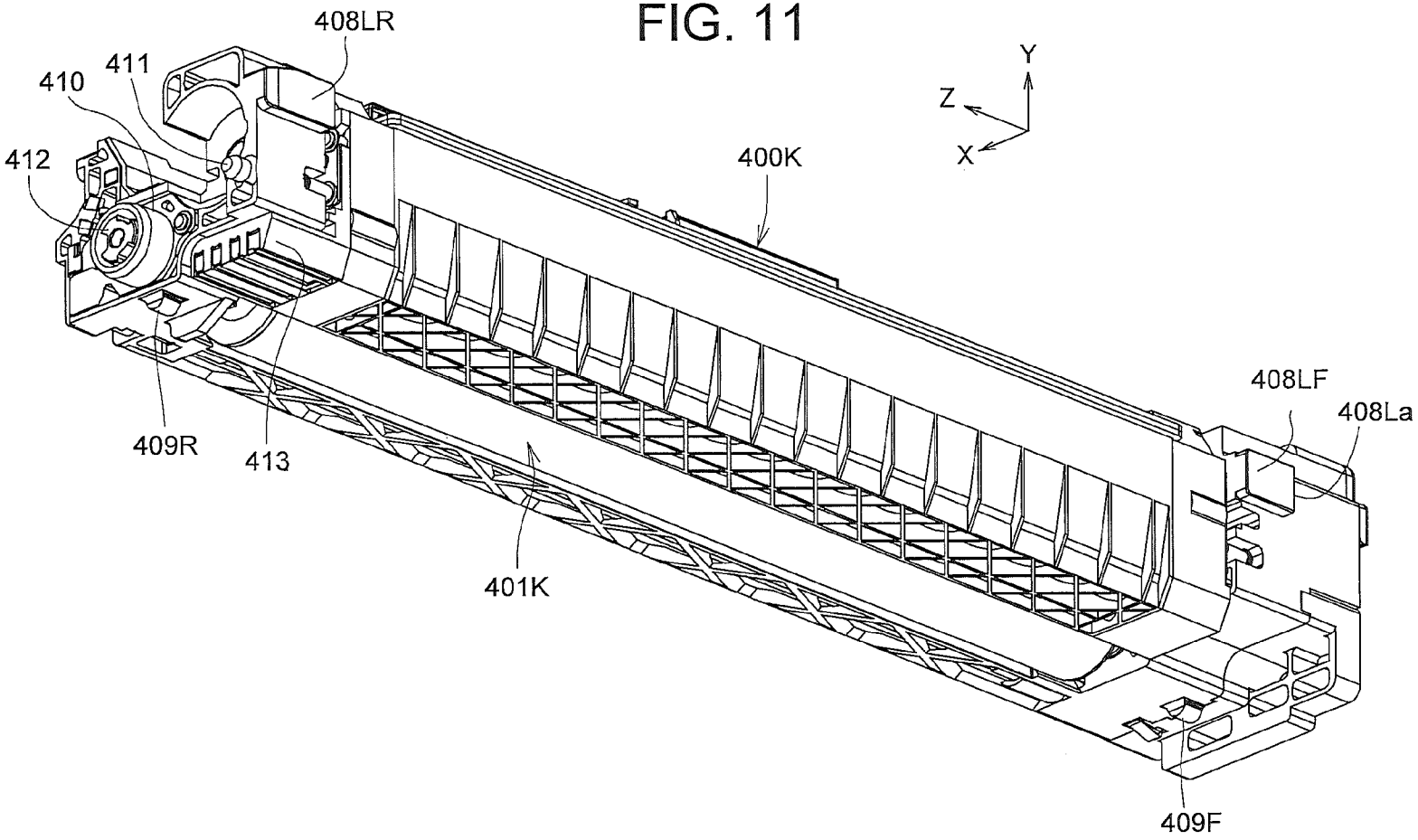
FIG. 11 is a bottom rear perspective view showing the process unit.
Figure 12:
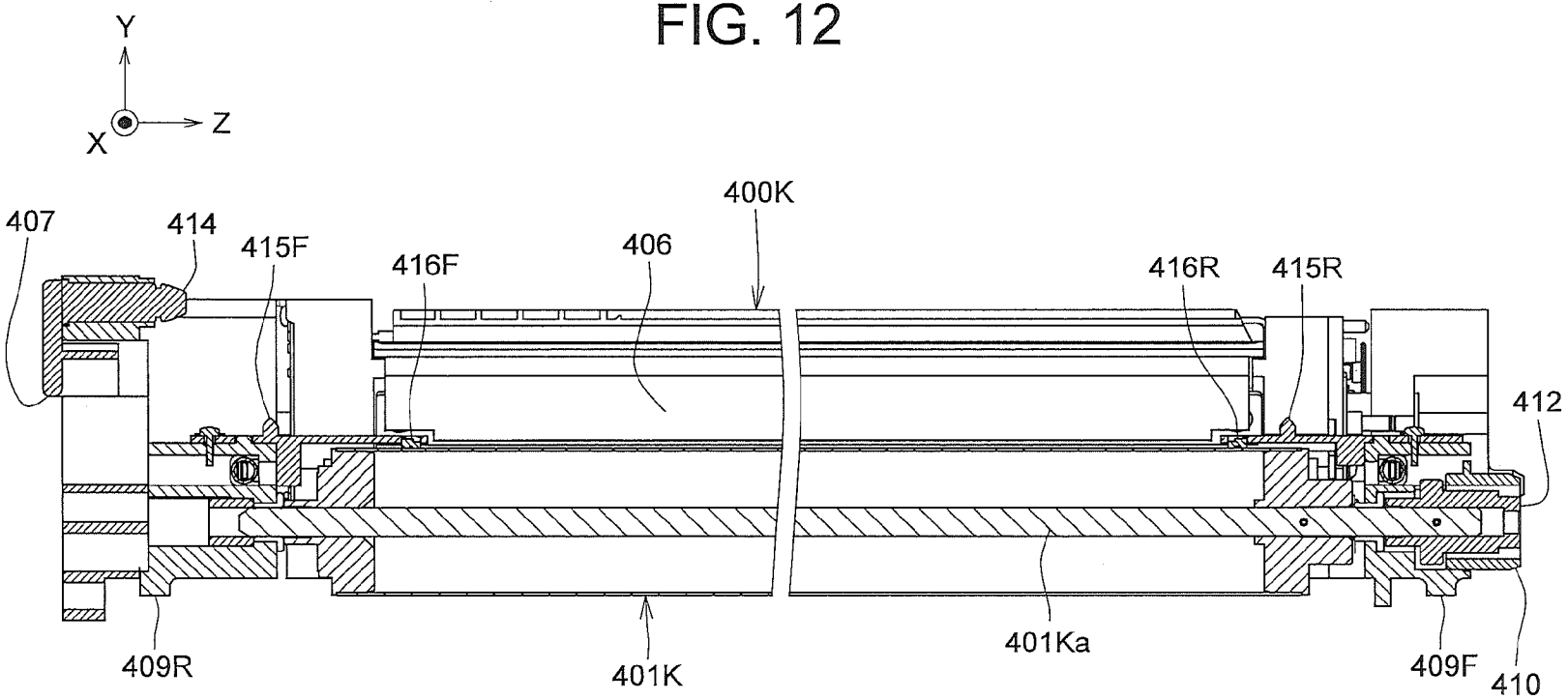
FIG. 12 is a longitudinal sectional view showing the process unit.

Next, the configurations of the process units 400K, 400C, 400M and 400Y will be described. FIGS. 10 through 12 are perspective view showing the process unit 400K. More specifically, FIG. 10 is a top and front perspective view of the process unit 400K. FIG. 11 is a bottom and rear perspective view of the process unit 400K. FIG. 12 is a longitudinal sectional view of the process unit 400K taken along line XII-XII in FIG. 10. The process units 400C, 400M and 400Y have the same configurations as the process unit 400K.

As shown in FIG. 10, a handle portion 407 is provided at a front end portion of the process unit 400K. The handle portion 407 is used when a user mounts the process unit 400K to the unit holding portion 800K or detaches the process unit 400K from the unit holding portion 800K. The user can grip the handle portion 407 to operate the process unit 400K.

As shown in FIG. 10, a rail portion 408R is formed on a right side surface of the process unit 400K. The rail portion 408R extends in Z direction. As shown in FIG. 11, a front rail portion 408LF and a rear rail portion 408LR are formed on a left side surface of the process unit 400K. When the process unit 400K is mounted to the unit holding portion 800K, the rail portion 408R is guided by the guide portion 801*a* of the unit holding portion 800K, and the front rail portion 408LF and the rear rail portion 408LR are guided by the guide portion 801*b* of the unit holding portion 800K.

Figure 13:
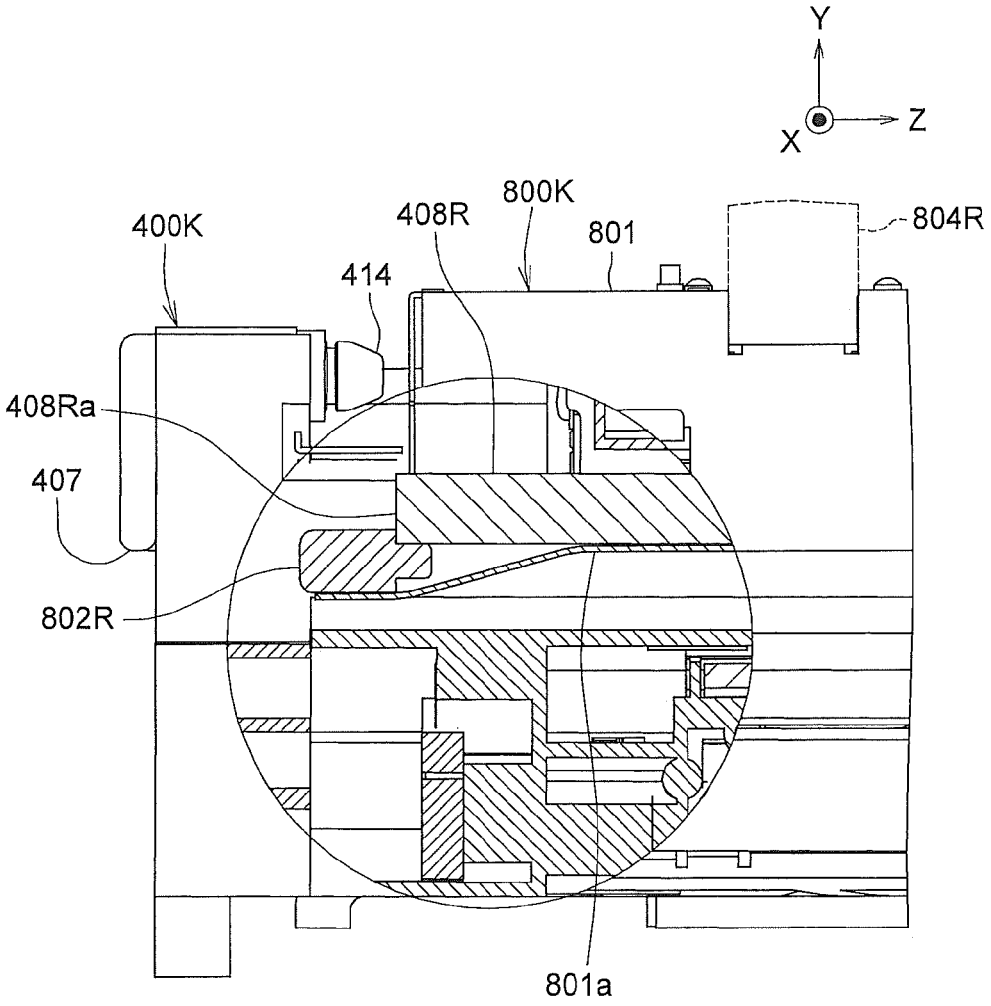
FIG. 13 is a sectional view showing a part of the process unit mounted to the unit holding portion.

FIG. 13 is a sectional view showing a part of the process unit 400K in a state where the process unit 400K is mounted to the unit holding portion 800K. As shown in FIG. 13, when the process unit 400K is mounted to the unit holding portion 800K, the rail portion 408R of the process unit 400K moves beyond the lock piece 802R to reach the guide portion 801*a*, and is mounted to the guide portion 801*a*. In this state, a contact surface 408Ra (i.e., a tip end surface) of the rail portion 408R engages a rear end surface of the lock piece 802R. Therefore, a position of the process unit 400K in Z direction is determined. Similarly, the front rail portion 408LF and the rear rail portion 408LR move beyond the lock piece 802L and reach the guide portion 801*b* (FIG. 8), and are mounted to the guide portion 801*b*. In this state, a contact surface 408La (i.e., a tip end surface) of the front rail portion 408LF engages a rear end surface of the lock piece 802L, and therefore the position of the process unit 400K in Z direction is determined.

Upon detaching the process unit 400K from the unit holding portion 800K, the user lifts the process unit 400K upward in +Y direction, releases engagement between the rail portion 408R and the lock piece 802R, and releases engagement between the front rail portion 408LF and the lock piece 802L.

As shown in FIGS. 10 and 12, the process unit 400K has engagement pin 414 that protrudes in +Z direction. As shown in FIG. 5A, engagement holes 12*k*, 12*c*, 12*m* and 12*y* are formed on a front plate 12 of the apparatus main body 10. FIG. 5B is an enlarged view of the engagement hole 12*k* for the process unit 400K. When the process unit 400K is mounted to the unit holding portion 800K, the engagement pin 414 of the process unit 400K engages the engagement hole 12*k* of the front plate 12 to determine the position of the process unit 400K in X direction and in Z direction.

Further, as shown in FIG. 12, the process unit 400K includes the photosensitive drum 401K having a cylindrical shape. A shaft portion 401Ka of the photosensitive drum 401K is rotatably supported. An end of the shaft portion 401Ka is supported by a sleeve 410 of the process unit 400K via a coupling 412.

As shown in FIG. 11, a tip of the coupling 412 has a concave-convex shape for transmitting a rotational driving force from the drum motor (not shown) to the shaft portion 401Ka of the photosensitive drum 401K. The sleeve 410 engages the through-hole 803*b* of the unit holding portion 800K shown in FIGS. 8 and 9, and determines a position of the sleeve 410 with respect to the unit holding portion 800K. A positioning pin 411 (FIG. 11) is formed on a rear end portion of the process unit 400K. The positioning pin 411 engages a through-hole 803*a* of the unit holding portion 800K shown in FIGS. 8 and 9 to prevent a rotation of the process unit 400K upon mounting the process unit 400K.

An electric contact 413 is provided at a rear portion of the process unit 400K. The electric contact 413 contacts the connection terminal 806 (FIG. 8) of the unit holding portion 800K when the process unit 400K is mounted to the unit holding portion 800K. Bias voltages for image forming process are applied to the process unit 400K via the electric contact 413. The electric contact 413 is resiliently biased in −Z direction, and therefore pushes the process unit 400K in −Z direction upon mounting the process unit 400K. Therefore, the contact surface 408Ra of the rail portion 408R contacts the rear end surface of the lock piece 802R of the unit holding portion 800K. The contact surface 408La of the rail portion 408LF contacts the rear end surface of the lock piece 802L of the unit holding portion 800K. As a result, a relative position of the process unit 400K with respect to the unit holding portion 800K is determined.

As shown in FIGS. 11 and 12, protruding portions 409R and 409F are formed on a bottom of the process unit 400K. The protruding portions 409R and 409F are used to determine the position of the process unit 400K with respect to the intermediate transfer belt unit 700 described later. Further, as shown in FIG. 12, the process unit 400K has positioning pins 415F and 415R and head abutment portions (i.e., head abutment pieces) 416F and 416R formed between a side wall 406 and the rail portion 408R. The positioning pins 415F and 415R and the head abutment portions 416F and 416R are used to determine the position of the process unit 400K with respect to the exposure unit 500K in X direction and Z direction.

Figure 14:
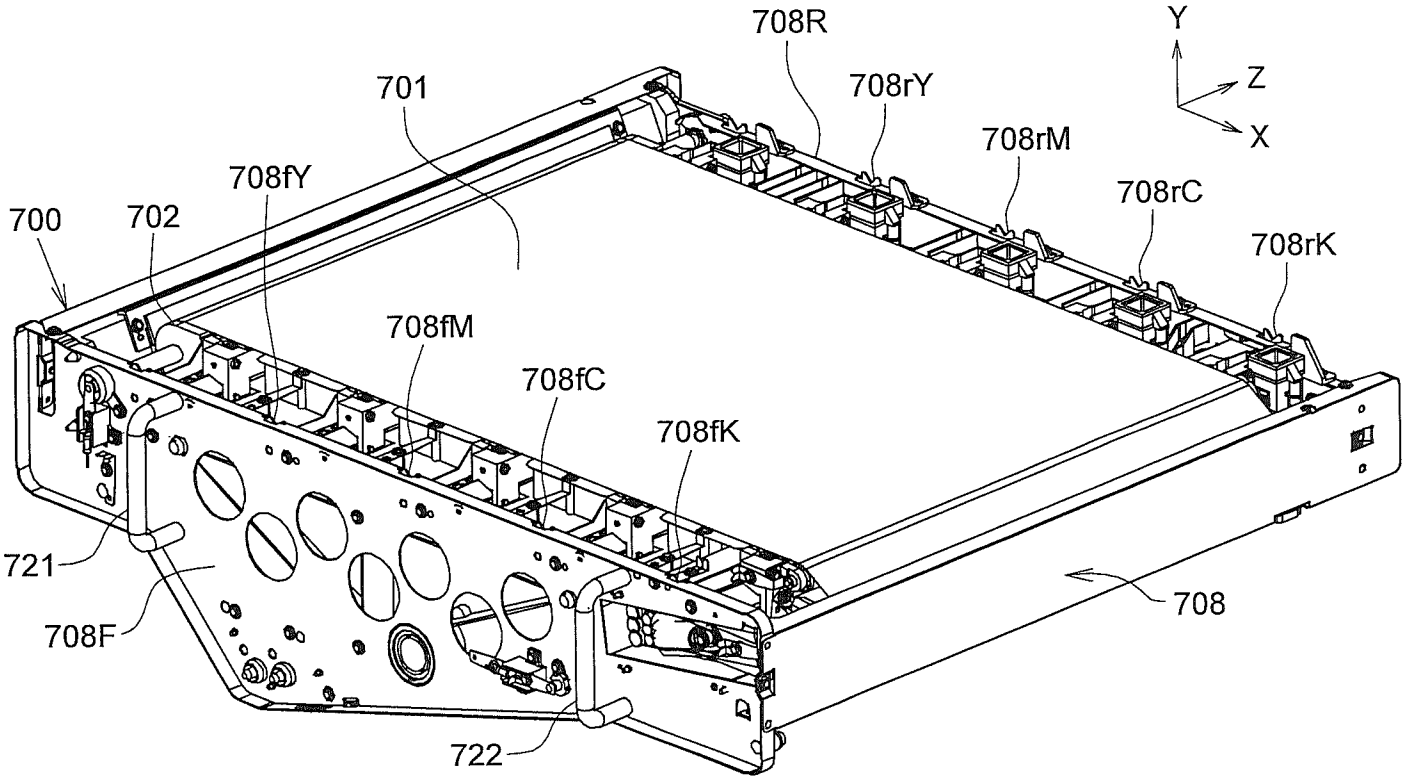
FIG. 14 is a top front perspective view showing the intermediate transfer belt unit.
Figure 15:
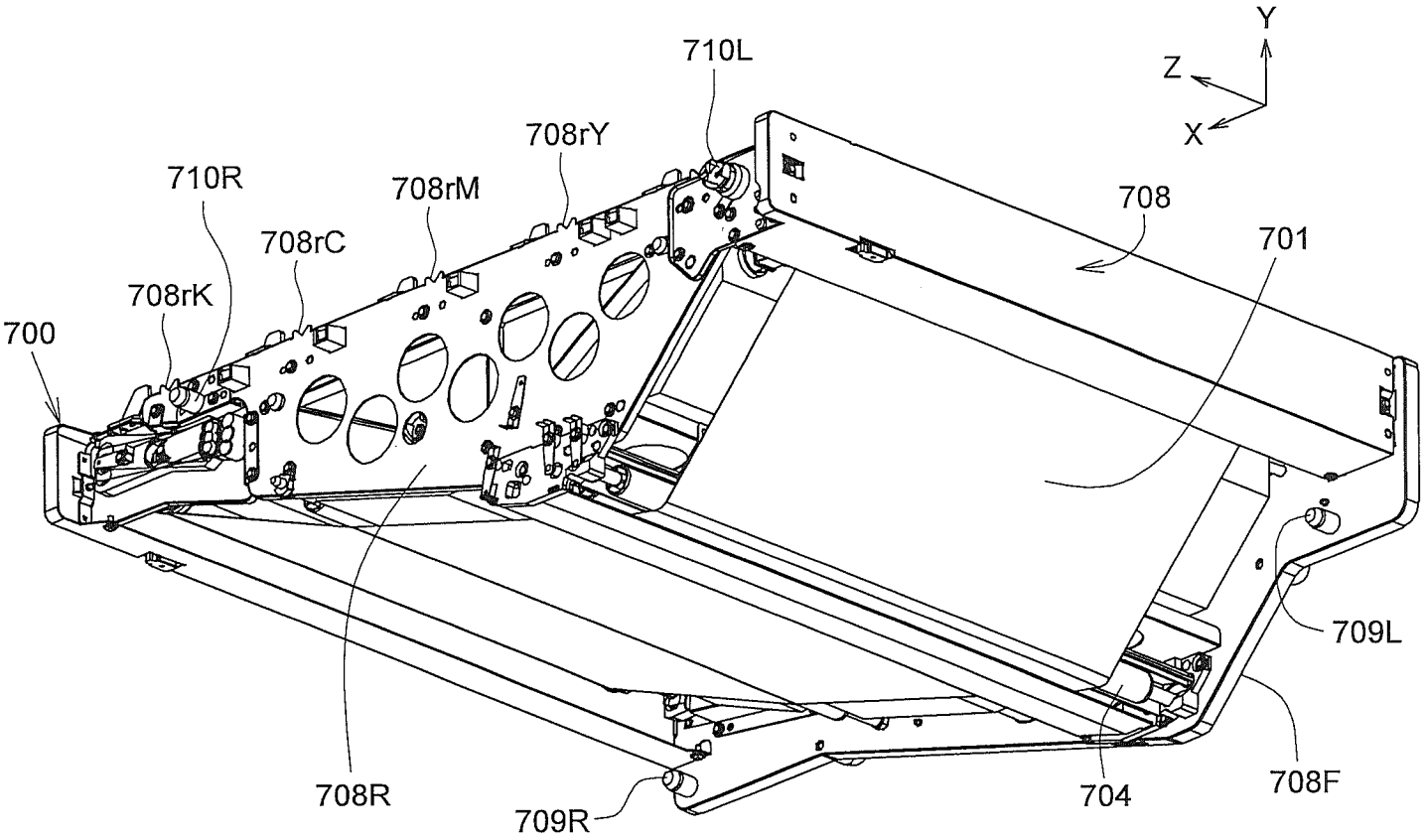
FIG. 15 is a bottom rear perspective view showing the intermediate transfer belt unit.

FIGS. 14 and 15 are perspective views of the intermediate transfer belt unit 700. More specifically, FIG. 14 is a top front perspective view showing the intermediate transfer belt unit 700. FIG. 15 is a bottom rear perspective view showing the intermediate transfer belt unit 700.

The intermediate transfer belt unit 700 includes a frame 708 made of metal. The intermediate transfer belt unit 700 further includes a driving roller 702, a tension roller 703, and a backup roller 704 which are rotatably supported by the frame 708. The intermediate transfer belt 701 is stretched around the driving roller 702, the tension roller 703 and the backup roller 704.

The frame 708 includes a front frame 708F and a rear frame 708R. As shown in FIG. 14, a pair of handles 721 and 722 are provided on the front frame 708F. A user can grip the handles 721 and 722 to move the intermediate transfer belt unit 700. As shown in FIG. 15, positioning pins 709R and 709L are provided on an inner surface of the front frame 708F. Positioning pins 710R and 710L are provided on the rear frame 708R. The positioning pins 709R, 709L, 710F and 710R are used to determine the position of the intermediate transfer belt unit 700 when the intermediate transfer belt unit 700 is mounted to the apparatus main body 10. Therefore, for example, the positioning pins 709R and 709L respectively engage engagement holes 12*h* and 12*i* formed on the front plate 12 shown in FIG. 5. The positioning pin 710L also functions as a driving shaft that transmits a rotational driving force to the driving roller 702.

Further, as shown in FIG. 14, V-shaped receiving grooves 708*f*K, 708*f*C, 708*f*M and 708*f*Y are formed at an upper end of the front frame 708F. Further, V-shaped receiving grooves 708*r*K, 708*r*C, 708*r*M and 708*r*Y are formed at an upper end of the rear frame 708R. The receiving grooves 708*f*K and 708*r*K are used to determine the position of the process unit 400K with respect to the intermediate transfer belt unit 700. The receiving grooves 708*f*C and 708*r*C are used to determine the position of the process unit 400C with respect to the intermediate transfer belt unit 700. The receiving grooves 708*f*M and 708*r*M are used to determine the position of the process unit 400M with respect to the intermediate transfer belt unit 700. The receiving grooves 708*f*Y and 708*r*Y are used to determine the position of the process unit 400Y with respect to the intermediate transfer belt unit 700.

Figures 16A, 16B, 16C:
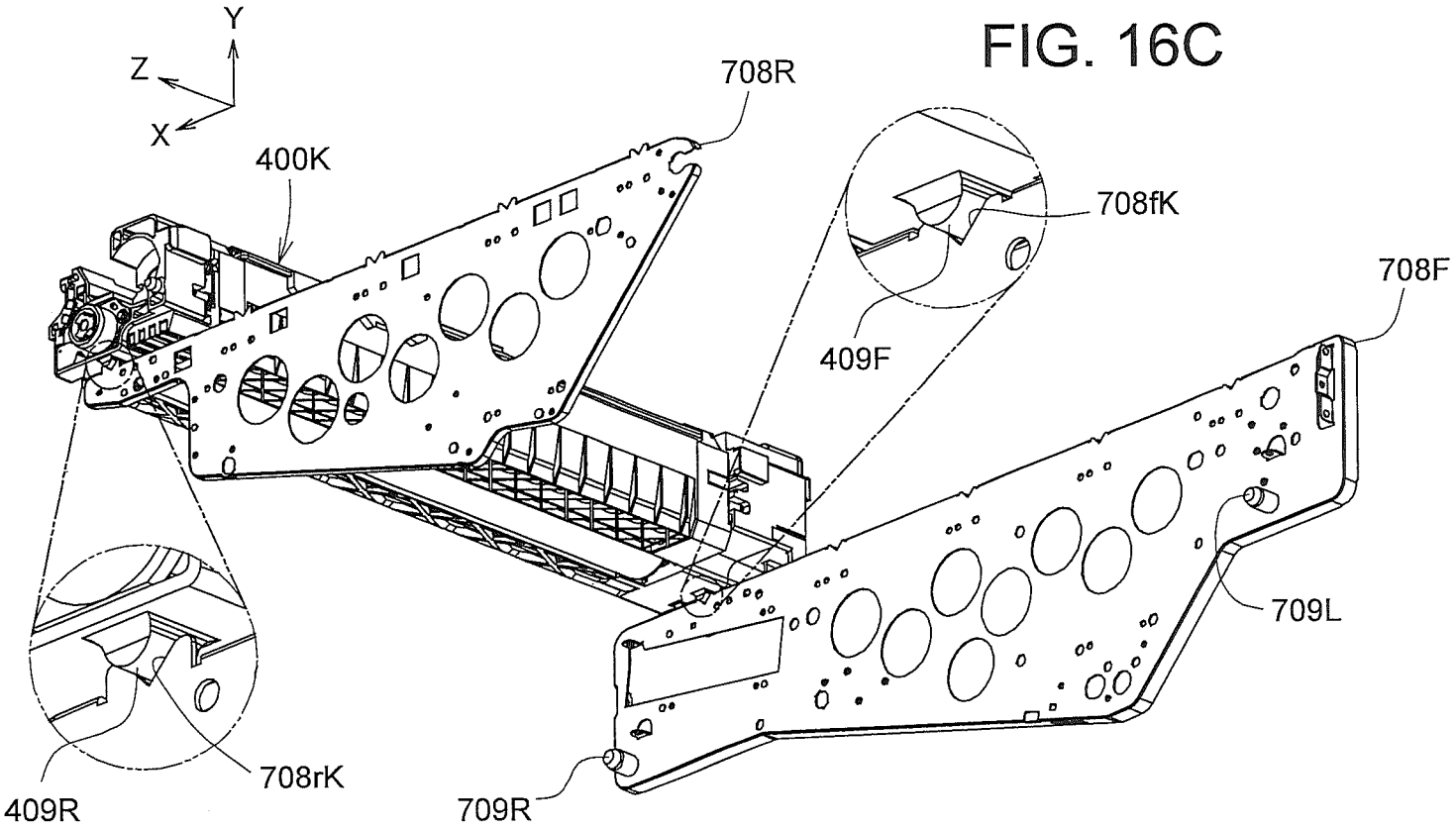
FIG. 16A is a perspective view showing a relationship between the intermediate transfer belt unit and the process unit.
FIGS. 16B and 16C are enlarged views showing engaging portions between the intermediate transfer belt unit and the process unit.

FIG. 16A is a perspective view showing a positional relationship between the intermediate transfer belt unit 700 and the process unit 400K. FIGS. 16B and 16C are enlarged views of an engaging portion between the intermediate transfer belt unit 700 and the process unit 400K. As shown in FIGS. 16B and 16C, the protruding portion 409R of the process unit 400K engages the receiving groove 708*r*K of the rear frame 708R, and the protruding portion 409F of the process unit 400K engages the receiving groove 708*f*K of the front frame 708F.

Figure 17:
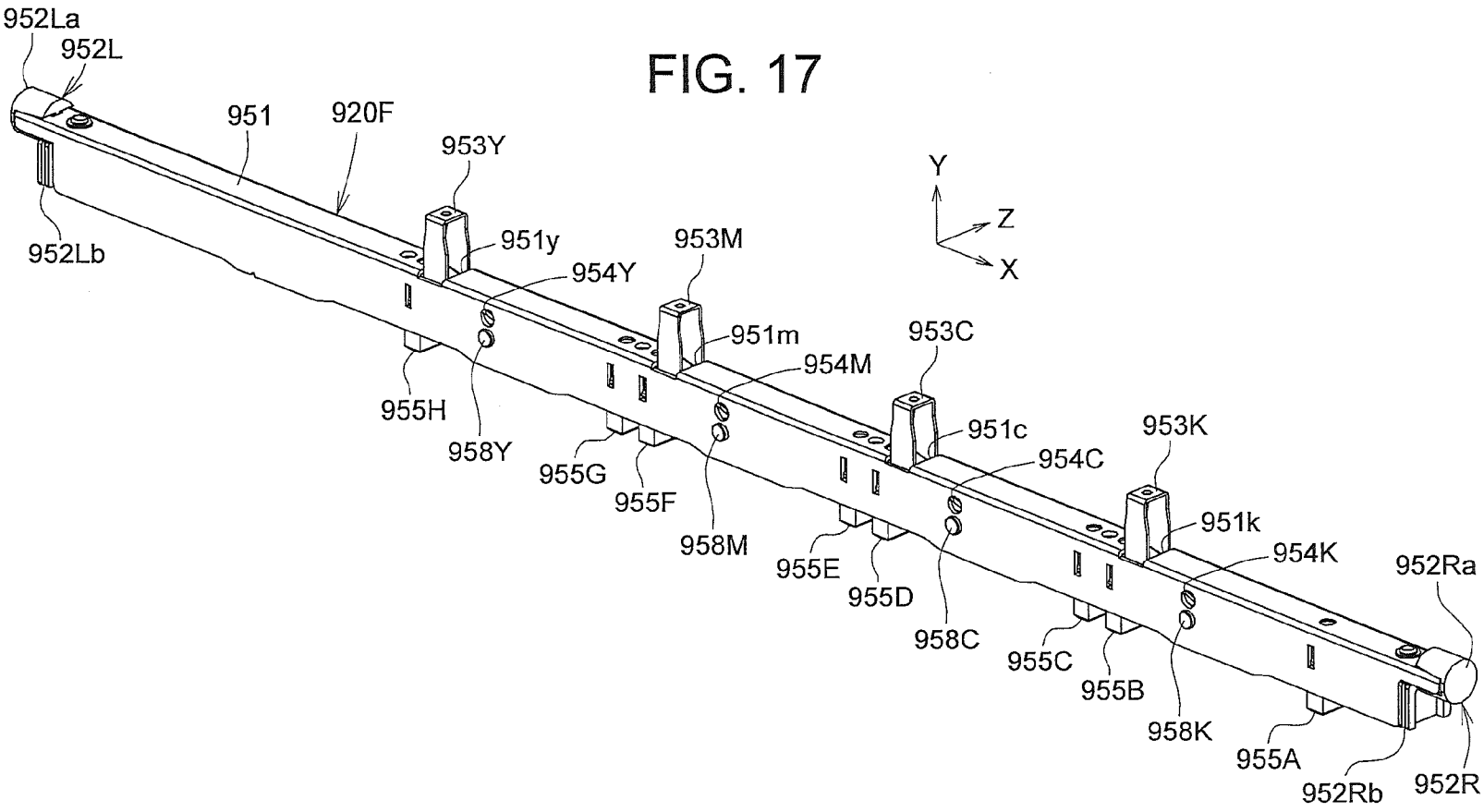
FIG. 17 is a perspective view showing an external configuration of a beam unit according to the first embodiment.

Next, description will be made of the beam units 920F and 920R that support the unit holding portions 800K, 800C, 800M and 800Y in a suspending manner. FIG. 17 is a perspective view showing the front beam unit 920F. The rear beam unit 920R has the same configuration as the front beam unit 920F.

As shown in FIG. 17, the front beam unit 920F includes a beam member (i.e., a frame) 951, cap members 952R and 952L provided at both ends of the beam member 951. The cap member 952R includes a cylindrical portion 952Ra and an engagement portion 952Rb with a groove extending in Y direction. The cap member 952L includes a cylindrical portion 952La and an engagement portion 952Lb with a groove extending in Y direction. As shown in FIG. 6, the cap members 952R and 952L respectively engage through-holes (i.e., support holes) formed on the lever members 912R and 912L, and are supported by the lever members 912R and 912L. Further, the engagement portions 952Rb and 952Lb respectively slidably engage protrusions formed on rectangular holes of the right side plate 14 and the left side plate 15 of the apparatus main body 10. For example, the engagement portion 952Lb of the front beam unit 920F engages the protrusion 14*e* on the rectangular hole formed on the right side plate 14 shown in FIGS. 5A and 5C. Similarly, the engagement portion of the rear beam unit 920R engages the protrusion 14*f* on the rectangular hole formed on the right side plate 14 shown in FIGS. 5A and 5C.

The front beam unit 920F includes biasing pieces 955A, 955B, 955C, 955D, 955E, 955F, 955G and 955H which are biased in −Y direction by a resilient member such as a coil spring. The biasing pieces 955A through 955H contact the unit holding portions 800K through 800Y (supported by the beam unit 920F) and bias the unit holding portions 800K through 800Y in −Y direction. More specifically, the biasing pieces 955A and 955B bias an upper surface of the unit holding portion 800K in −Y direction. The biasing pieces 955C and 955D bias an upper surface of the unit holding portion 800C in −Y direction. The biasing pieces 955E and 955F bias an upper surface of the unit holding portion 800M in −Y direction. The biasing pieces 955G and 955H bias an upper surface of the unit holding portion 800Y in −Y direction.

Each of the beam units 920F and 920R includes four linking mechanisms for linking the unit holding portions 800K, 800C, 800M and 800Y and the exposure units 500K, 500C, 500M and 500Y. Each linking mechanism is configured to cause the exposure units 500K, 500C, 500M and 500Y to move toward or away from the unit holding portions 800K, 800C, 800M and 800Y in conjunction with the operation of the linking mechanisms 910R and 910L shown in FIG. 6.

Figure 18:
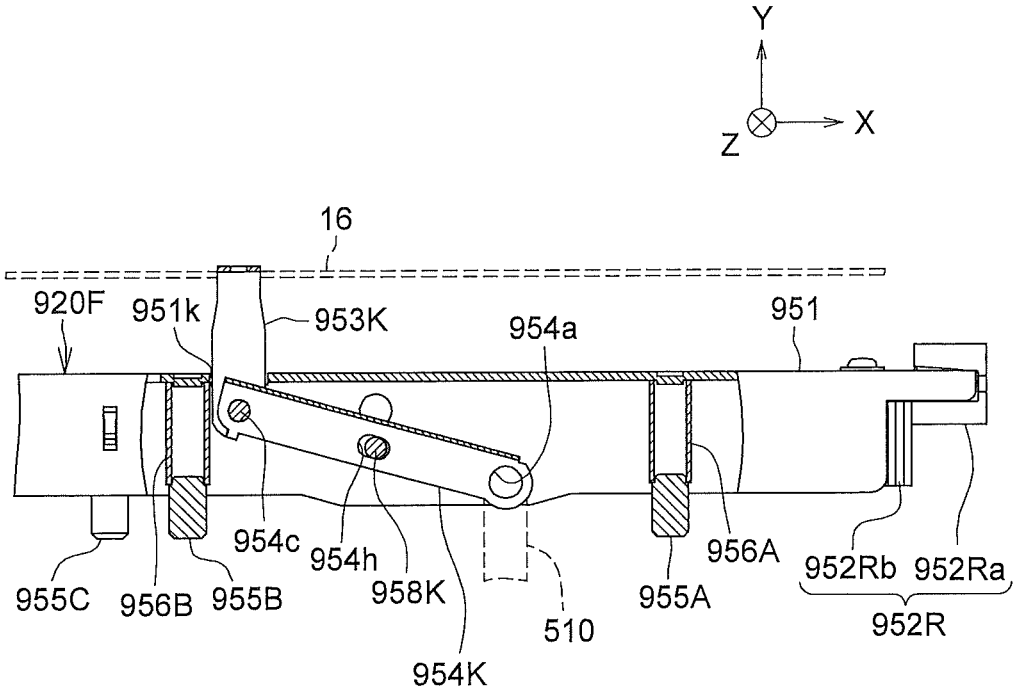
FIG. 18 is a schematic sectional view showing a configuration of one of linking mechanisms for linking the unit holder potion and an exposure unit.

FIG. 18 is a schematic sectional view showing one of the linking mechanisms for linking the unit holding portions 800K, 800C, 800M and 800Y and the exposure unit 500K. The linking mechanism shown in FIG. 18 includes a linking lever member 954K for linking the linking mechanisms 910R and 910L (FIG. 6) and the exposure unit 500K, and a pivoting plate (i.e., a movement restriction member) 953K that restricts a movement of an end portion of the linking lever member 954K relative to the apparatus main body 10.

The end portion of the linking lever member 954K is rotatably connected to a supporting portion 954*c* provided on the beam member 951. Further, a lower end portion of the pivoting plate 953K is also connected to the supporting portion 954*c*. The pivoting plate 953K protrudes from a through-hole 951*k* of the beam member 951. An upper end portion of the pivoting plate 953K is fixed to the top plate 16 of the apparatus main body 10. The other end portion of the linking lever member 954K has a mounting hole 954*a* to which a front connection piece 510 of the exposure unit 500K is rotatably connected as described later. Further, the linking lever member 954K has an elongated hole (i.e., an engagement hole) 954*h* formed between the supporting portion 954*c* and the mounting hole 954*a*. A support pin 958K fixed to the beam member 951 engages the elongated hole 954*h*.

The beam member 951 has resilient members 956A and 956B therein. The resilient members 956A and 956B resiliently bias the biasing pieces 955A and 955B in −Y direction. The biasing pieces 955A and 955B are configured to bias the unit holding portion 800K supported by the front beam unit 920F in a suspending manner.

When the beam member 951 moves in Y direction (i.e., upward or downward), a force vertically moving the beam member 951 is applied to the support pin 958K. The force applied to the support pin 958K is also applied to the mounting hole 954*a* (i.e., a point of application of the force) via the supporting portion 954*c* according to principle of leverage. As a result, the linking lever member 954K rotates clockwise or counterclockwise about the supporting portion 954*c*, and causes the connection piece 510 of the exposure unit 500K to move upward or downward relative to the front beam unit 920F.

Figure 19:
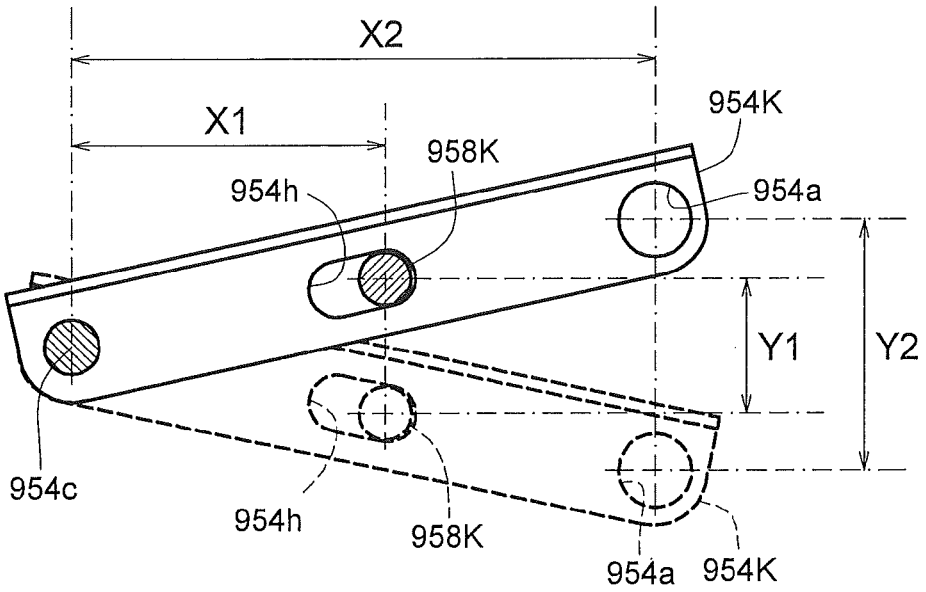
FIG. 19 is a schematic view showing a linking lever member that moves in association with a beam member.

FIG. 19 is a schematic view showing states of the linking lever member 954K linked with the beam member 951. According to the opening operation of the front cover portion 24, the beam member 951 moves upward. In conjunction with the upward movement of the beam member 951, the linking lever member 954K rotates from a position shown by a dashed line to a position shown by a solid line. According to the closing operation of the front cover portion 24, the beam member 951 moves downward. In conjunction with the downward movement of the beam member 951, the linking lever member 954K rotates (i.e., returns) from the position shown by the solid line to the position shown by the dashed line.

As shown in FIG. 19, a distance from a center of the supporting portion 954*c* to a center of the support pin 958K in a lateral direction (i.e., X direction) is expressed as X1. A distance from a center of the supporting portion 954*c* to a center of the mounting hole 954*a* is expressed as X2. A distance move by the support pin 958K in a vertical direction (i.e., Y direction) according to the opening/closing operation of the front cover member 24 is expressed as Y1. In this state, the mounting hole 954*a* rotates about the supporting portion 954*c* according to principle of leverage, and therefore moves a distance Y2 greater than the distance Y1. In this state, the following equation is satisfied: $Y2=Y1\times(X2/X1)$. For example, when it is assumed that X1 is 26 mm, X2 is 50 mm and Y1 is 14 mm, the result is that Y2 is 26.9 mm.

The front beam unit 920F includes the linking mechanisms for other exposure units 500C, 500M and 500Y which are similar to the linking mechanism for the exposure unit 500K. As shown in FIG. 17, the front beam unit 920F includes a pivoting plate 953C, a linking lever member 954C and a support pin 958C that constitute a linking mechanism for linking the exposure unit 500C and the unit holding portions 800K through 800Y. The front beam unit 920F further includes a pivoting plate 953M, a linking lever member 954M and a support pin 958M that constitute a linking mechanism for linking the exposure unit 500M and the unit holding portions 800K through 800Y. The front beam unit 920F further includes a pivoting plate 953Y, a linking lever member 954Y and a support pin 958Y that constitute a linking mechanism for linking the exposure unit 500Y and the unit holding portions 800K through 800Y. The pivoting plates 953C, 953M and 953Y respectively protrude upward from through-holes 951*c*, 951*m* and 951*y* formed on the beam member 951, and are fixed to the top plate 16.

In this regard, the linking lever members 954K, 954C, 954M and 954Y and the pivoting plates 953K, 953C, 953M and 953Y constitute a second mechanism that causes the process unit 400K, 400C, 400M and 400Y (i.e., the second unit) and the exposure units 500K, 500C, 500M and 500Y (i.e., the third unit) to move toward or away from each other.

The rear beam unit 920R has the linking mechanisms having the same configurations as those of the front beam unit 920F.

Figure 20:
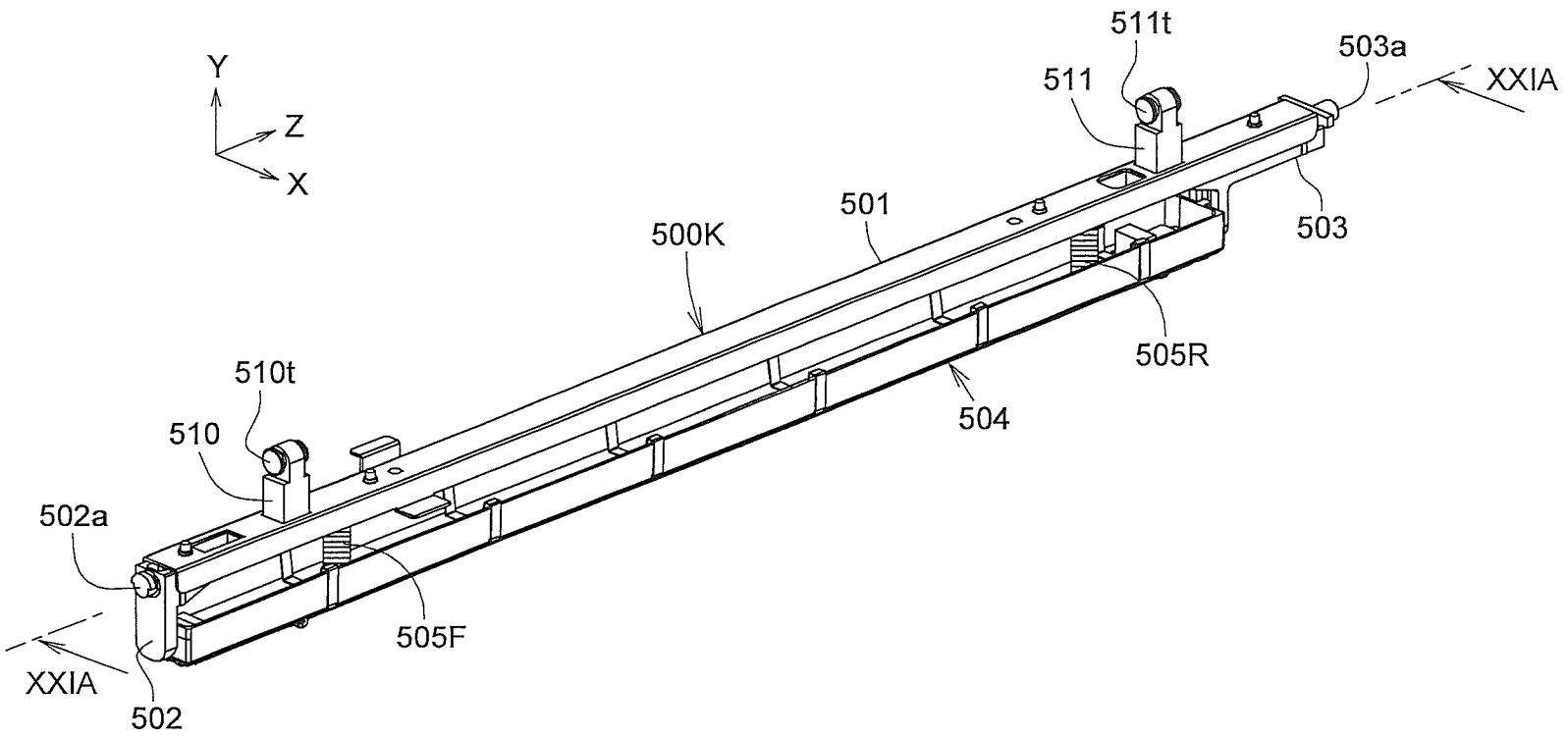
FIG. 20 is a perspective view showing the exposure unit according to the first embodiment.
Figure 21A:
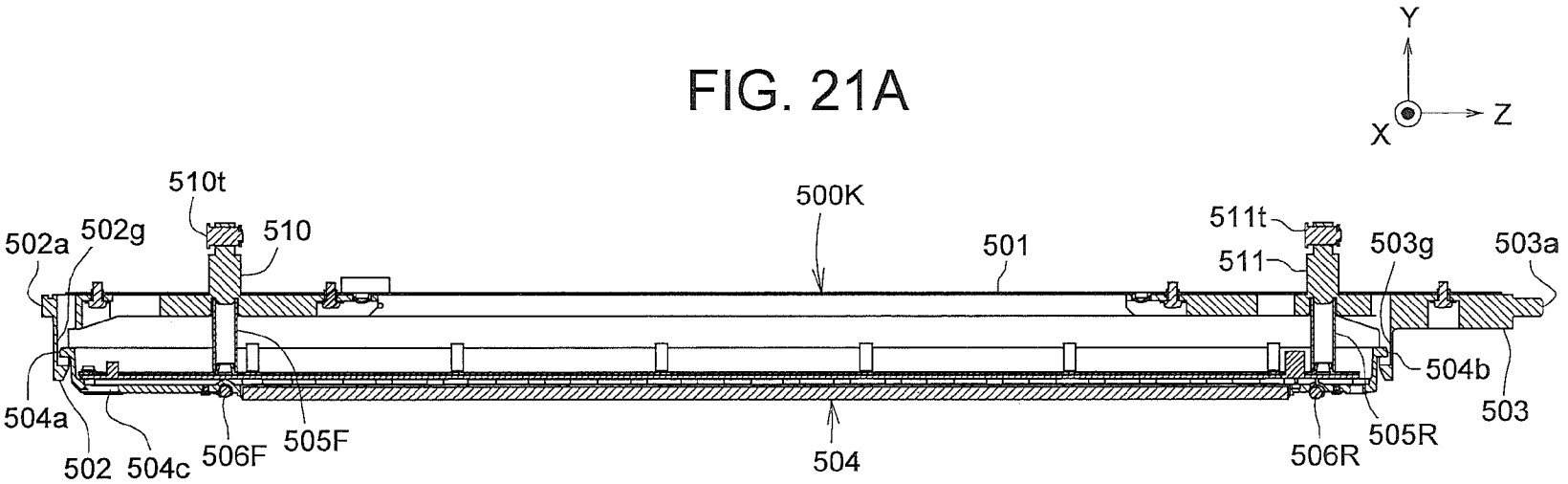
FIGS. 21A and 21B are a longitudinal sectional view and a bottom view of the exposure unit shown in FIG. 20.
Figure 21B:
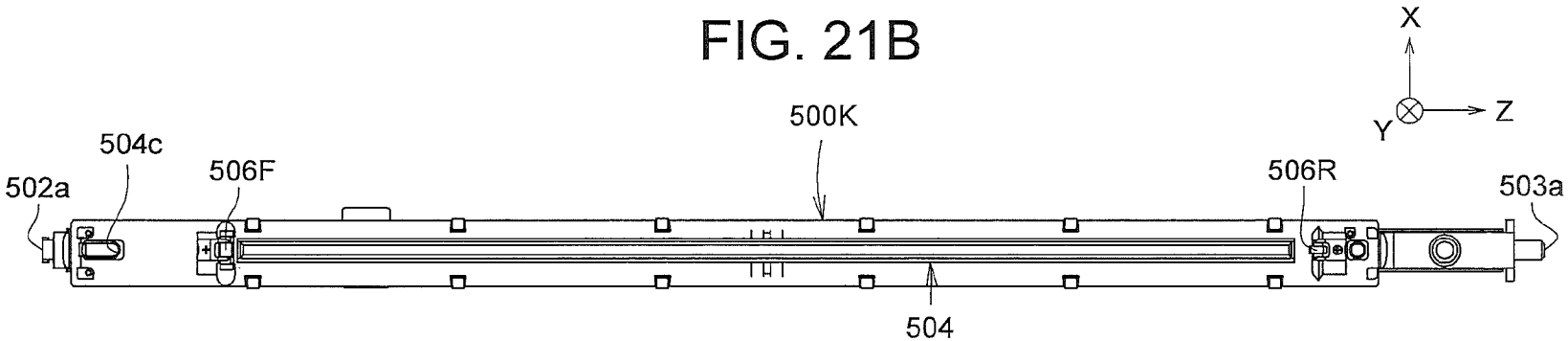

FIG. 20 is a perspective view showing an external configuration of the exposure unit 500K of the first embodiment. FIG. 21A is a longitudinal sectional view of the exposure unit 500K taken along line XXIA-XXIA in FIG. 20. FIG. 21B is a bottom view of the exposure unit 500K. The other exposure units 500C, 500M and 500Y have the same configurations as the exposure unit 500K.

As shown in FIG. 20, the exposure unit 500K includes a holder plate 501 extending in Z direction, and an LED head 504 mounted to the holder plate 501. The LED head 504 includes a large number of LED elements arranged along the longitudinal direction (i.e., Z direction), and a lens array that introduces light from the LED elements to the surface of the photosensitive drum 401K. The LED head 504 is resiliently biased in −Y direction by resilient biasing members 505F and 505R such as springs.

As shown in FIG. 21A, groove portions 502*g* and 503*g* are respectively formed on a front end portion 502 and a rear end portion 503 of the holder plate 501. Protrusions 504*a* and 504*b* are formed on front and rear ends of the LED head 504. The protrusions 504*a* and 504*b* respectively engage the groove portions 502*g* and 503*g*, so that the holder plate 501 supports the LED head 504 in a suspending manner.

Shaft portions 502*a* and 503*a* are respectively formed on the front end portion 502 and the rear end portion 503 of the exposure unit 500K. The shaft portions 502*a* and 503*a* respectively engage the elongated holes 801*f* and 803*r* (FIG. 8) of the unit holding portion 800K.

As shown in FIGS. 21A and 21B, focus adjusting members 506F and 506R are provided in the vicinities of both ends of the LED head 504 in the longitudinal direction. The focus adjusting members 506F and 506R are configured to contact the head abutment portions (i.e., the head abutment pieces) 416F and 416R shown in FIG. 12. By suitably adjusting outer diameters of the focus adjusting members 506F and 506R, a distance between the LED head 504 and the photosensitive drum 401K can be adjusted so as to obtain an optimum focal position of light emitted by the LED head 504. As shown in FIGS. 21A and 21B, an elongated hole 504*c* is formed on a bottom of the exposure unit 500K. The positioning pin 415F of the process unit 400K shown in FIG. 12 engages the elongated hole 504*c*.

Figure 22:
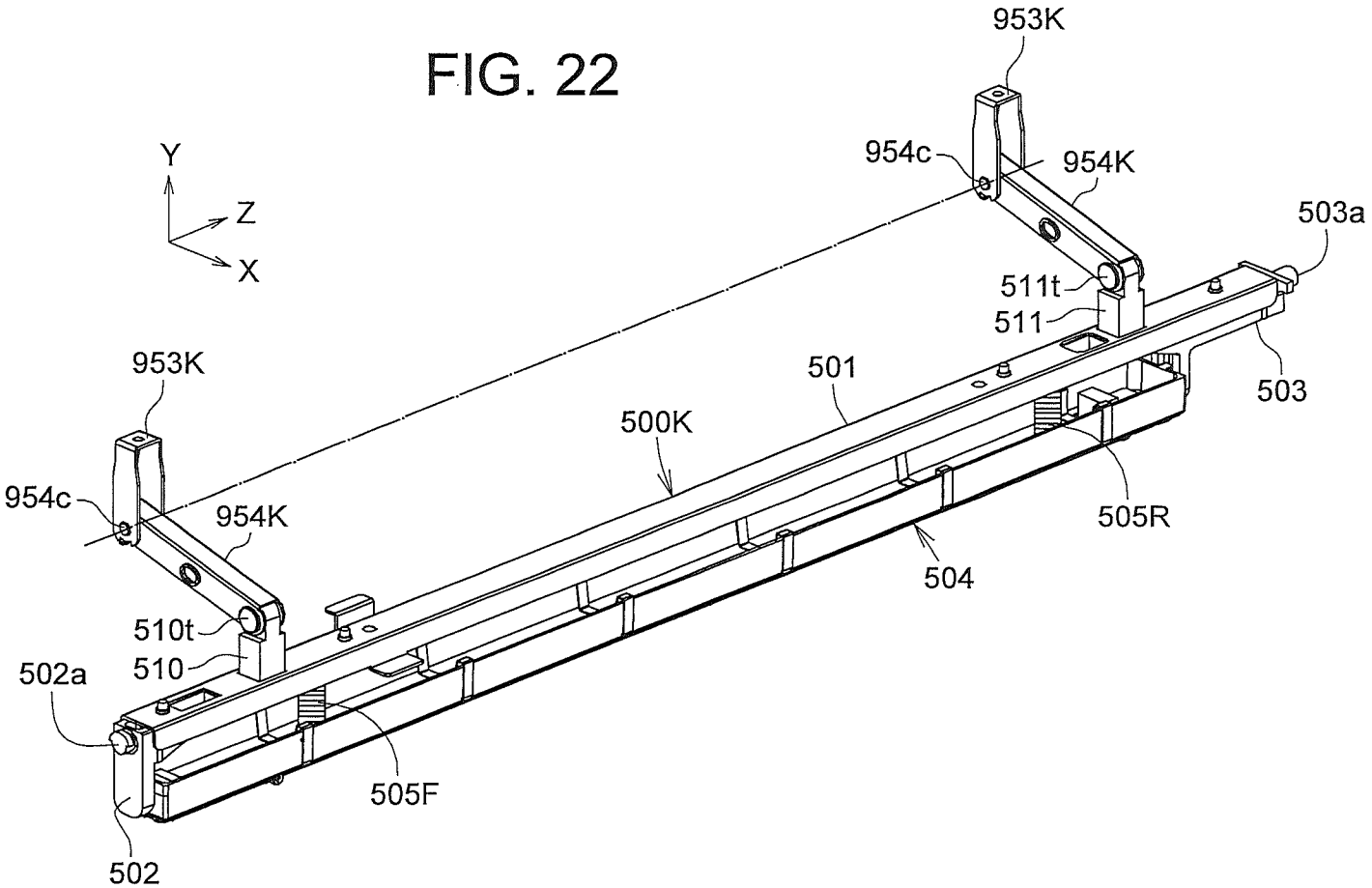
FIG. 22 is a perspective view showing an external configuration of the exposure unit according to the first embodiment.

The holder plate 501 has front and rear connection pieces 510 and 511 that protrude upward. Tip portions 510*t* and 511*t* of the connection pieces 510 and 511 respectively rotatably connected to the above described linking mechanisms of the beam units 920F and 920R. That is, as shown in FIG. 22, the tip portion 510*t* of the front connection piece 510 engages the linking lever member 954K of the linking mechanism of the front beam unit 920F. The tip portion 511*t* of the rear connection piece 511 engages the linking lever member 954K of the linking mechanism of the rear beam unit 920R.

Figure 23B:
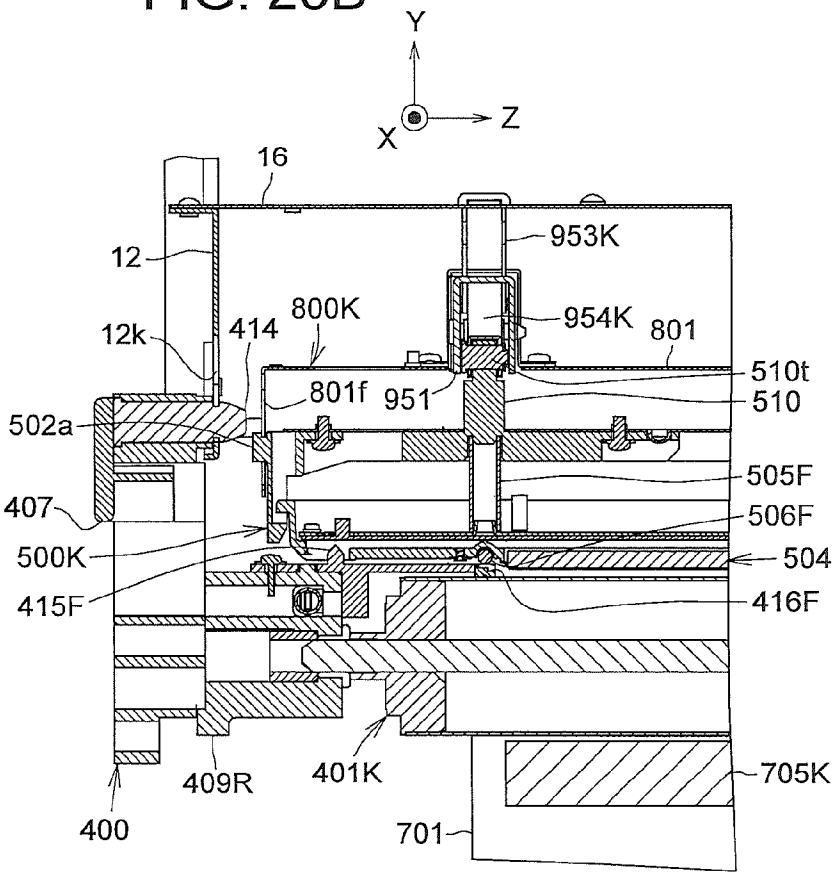
FIGS. 23A and 23B are sectional views showing the linking mechanism of the beam unit in a state where the cover member is in the closing position shown in FIG. 7A.
Figure 23A:
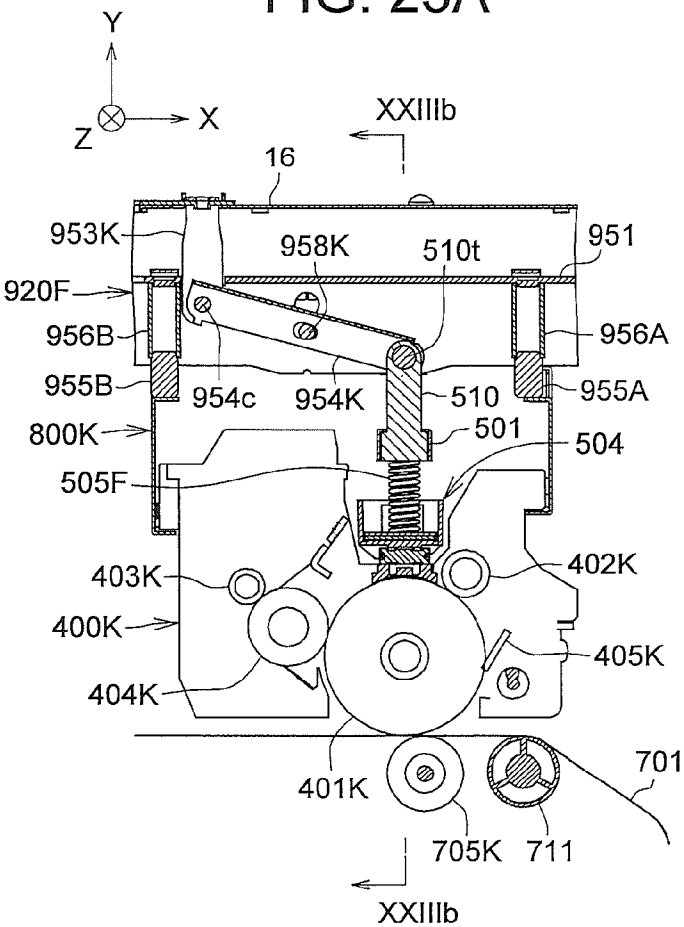
Figure 24B:
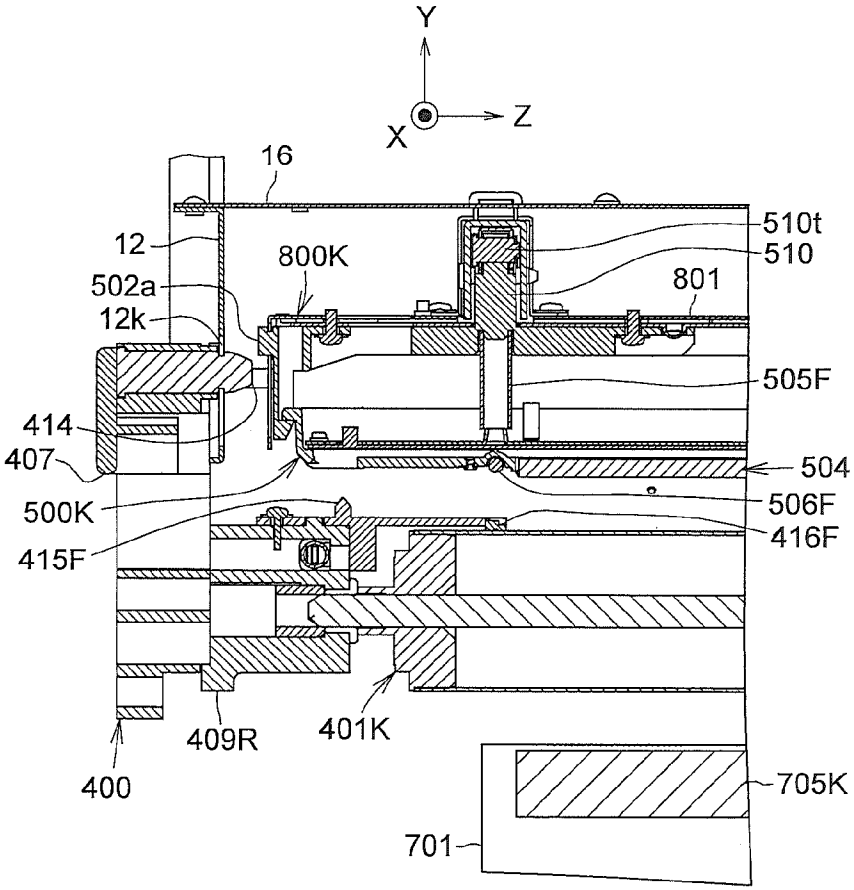
FIGS. 24A and 24B are sectional views showing the linking mechanism of the beam unit in a state where the cover member is in the opening position shown in FIG. 7B.
Figure 24A:
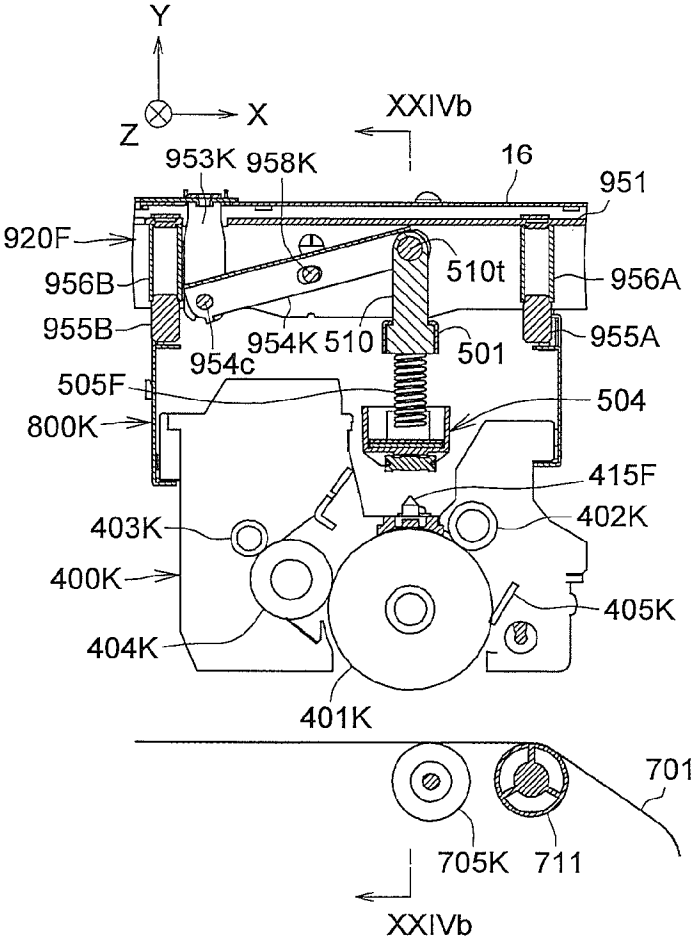

FIGS. 23A and 23B are sectional views schematically showing a state of the linking mechanism of the front beam unit 920F when the front cover portion 24 is in the closing position (FIG. 7A). FIG. 23B corresponds to a cross sectional view taken along a Line XXIIIb-XXIIIb in FIG. 23A. FIGS. 24A and 24B are sectional views schematically showing a state of the linking mechanism of the front beam unit 920F when the front cover portion 24 is in the opening position (FIG. 7B). FIG. 24B corresponds to a cross sectional view taken along a Line XXIVb-XXIVb in FIG. 24A.

When the front cover portion 24 is in the closing position, the unit holding portion 800K (supported by the front beam unit 920F in a suspending manner) is apart from the top plate 16 by a predetermined distance as shown in FIGS. 23A and 23B. The photosensitive drum 401K of the process unit 400K supported by the unit holding portion 800K is positioned close to the intermediate transfer belt 701. Further, the LED head 504 is positioned close to the surface of the photosensitive drum 401K.

In contrast, when the front cover portion 24 rotates from the closing position to the opening position, the unit holding portion 800K (supported by the front beam unit 920F in a suspending manner) moves upward as shown in FIGS. 24A and 24B. The photosensitive drum 401K of the process unit 400K supported by the unit holding portion 800K moves away from the intermediate transfer belt 701. Further, according to the rotation of the linking lever member 954K, the LED head 504 moves the distance Y2 (FIG. 19) greater than the moving amount (i.e., distance) Y1 of the front beam unit 920F, and moves away from the surface of the photosensitive drum 401K. In this state, the user can easily detach or replace the process unit 400K through the front opening 12*b* of the front plate 12.

Further, since the photosensitive drum 401K moves away from the intermediate transfer belt 701, and the LED head 504 moves away from the photosensitive drum 401K, it becomes possible to prevent the process unit 400K from contacting the LED head 504 or the intermediate transfer belt 701 when the user mounts the process unit 400K to or detaches the process unit 400K from the apparatus main body 10.

According to the image forming apparatus 1 of the first embodiment, the first mechanism (i.e., the linking mechanisms 910R and 910L and the beam units 920F and 920R) causes the intermediate transfer belt unit 700 (i.e., the first unit) and the process units 400K, 400C, 400M and 400Y (i.e., the second unit) to move toward and away from each other according to the opening/closing operation of the front cover potion 24. Further, the second mechanism (the linking lever members 954K, 954C, 954M and 954Y and the pivoting plates 953K, 953C, 953M and 953Y) causes the process units 400K, 400C, 400M and 400Y (i.e., the second unit) and the exposure units 500K, 500C, 500M and 500Y (i.e., the third unit) to move toward and away from each other in conjunction with the operation of the first mechanism. Therefore, the user can easily detach or replace the process units 400K, 400C, 400M and 400Y through the front opening 12*b* by rotating the front cover portion 24 to the opening position.

The above described embodiment is only a preferred example of the present invention, and various modifications may be made thereto.

In the above described embodiment, the first unit corresponds to the intermediate transfer belt unit 700, and the second unit corresponds to the process units 400K, 400C, 400M and 400Y. Further, the third unit corresponds to the exposure units 500K, 500C, 500M and 500Y. However, the first unit, the second unit and the third unit are not limited to this example. For example, it is also possible that the second unit corresponds to drum units, and the third unit corresponds to developing units.

Further, the image forming apparatus 1 can be provided with a cushion mechanism that generates a force resisting to the rotation of the front cover portion 24.

Figure 25:
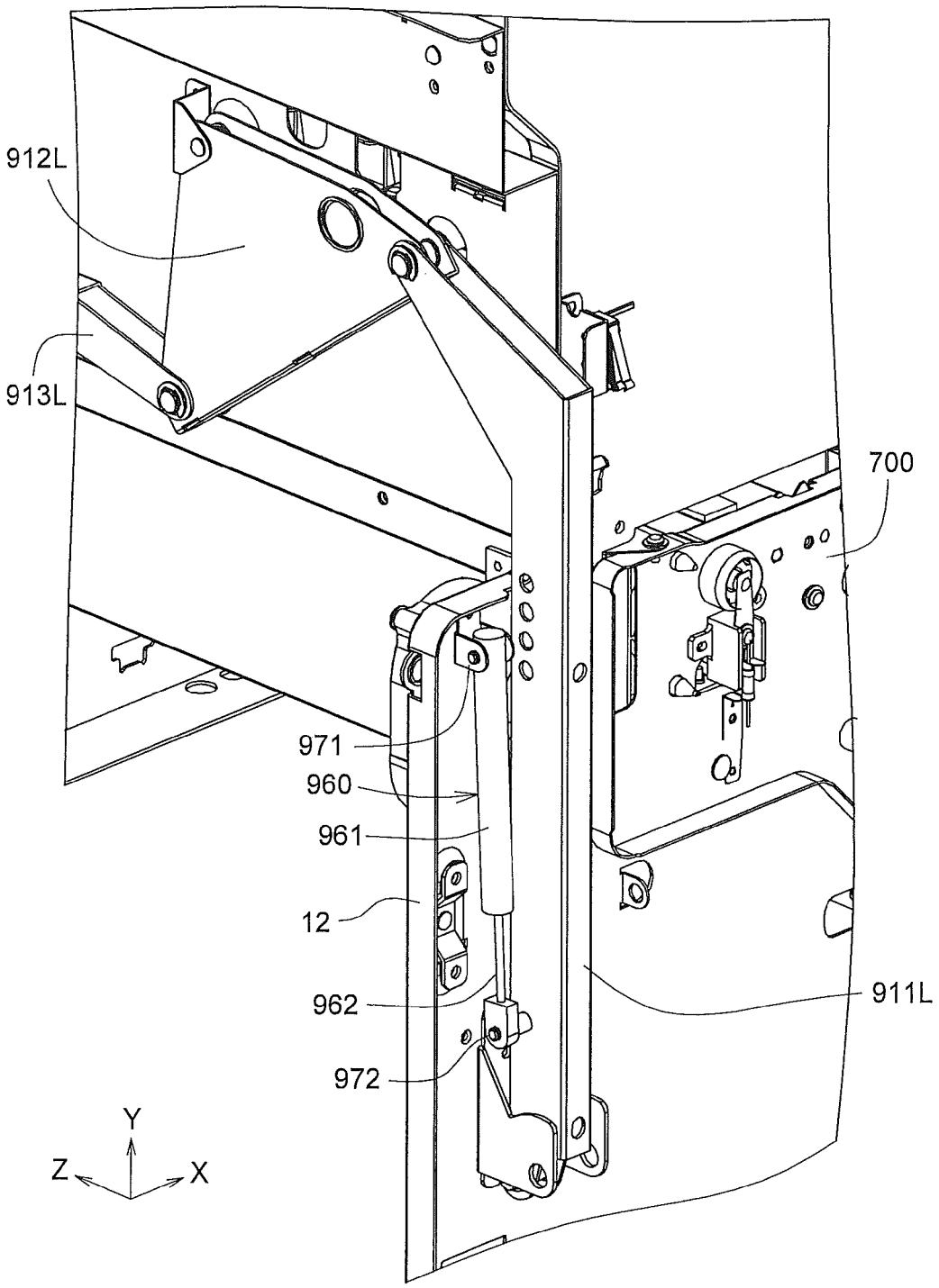
FIG. 25 is a perspective view showing a cushion mechanism provided between an arm member and an apparatus main body.
Figure 26B:
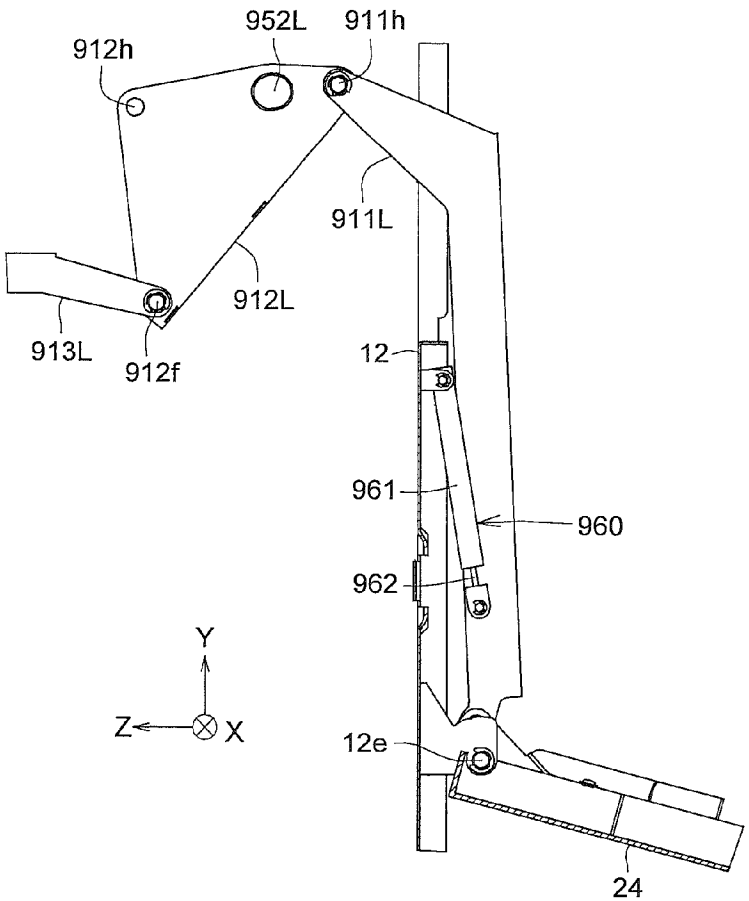
FIG. 26B is a schematic view showing the cushion mechanism in a state where the cover member is in the opening position.
Figure 26A:
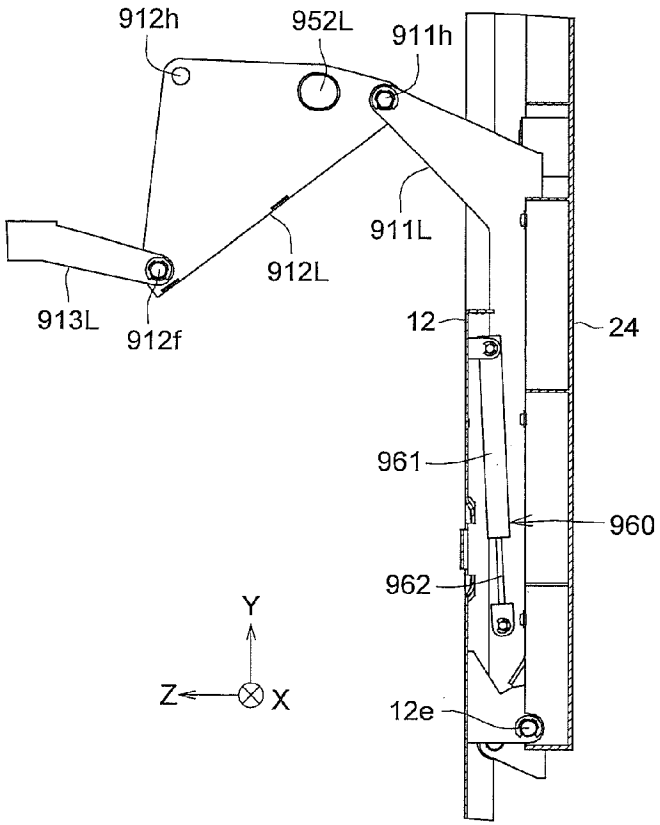
FIG. 26A is a schematic view showing the cushion mechanism in a state where the cover member is in the closing position.

FIG. 25 is a perspective view showing the cushion mechanism 960 provided between the arm member 911L and the front plate 12 of the apparatus main body 10. The cushion mechanism 960 is configured as a damper, and includes a cylinder 961 and a rod 962 extending from the cylinder 961. A base end of the cylinder 961 is rotatably mounted to the front plate 12 via a mounting element 971. A tip portion of the rod 962 is rotatably mounted to the arm member 911L via a mounting element 972. Fluid such as oil is filled inside the cylinder 961. The fluid generates a force resisting a movement of the rod 962 with respect to the cylinder 961. FIG. 26A shows the cushion mechanism 960 in a state where the front cover portion 24 is in the closing position. FIG. 26B shows the cushion mechanism 960 in a state where the front cover portion 24 is in the opening position. When the front cover portion 24 rotates from the closing position to the opening position, the rod 962 is retracted into the cylinder 961. In contrast, when the front cover portion 24 rotates from the opening position to the closing position, the rod 962 extends from the cylinder 961.

Using the cushion mechanism 960, the user can easily open and close the front cover portion 24. Further, optimum operational feeling can be obtained by adjusting the force (i.e., a resistant force) of the cushion mechanism 960 based on weights of the process units 400K, 400C, 400M and 400Y. In this regard, the damper can be replaced with a resilient member such as a coil spring.

The first and second mechanisms of the above described embodiment are suitably applied to the image forming apparatus 1 configured to transfer an image using the intermediate transfer system. However, the present invention is not limited to such an image forming apparatus. For example, the first and second mechanisms of the above described embodiment are applicable to an image forming apparatus using a direct transfer system.

Figure 27:
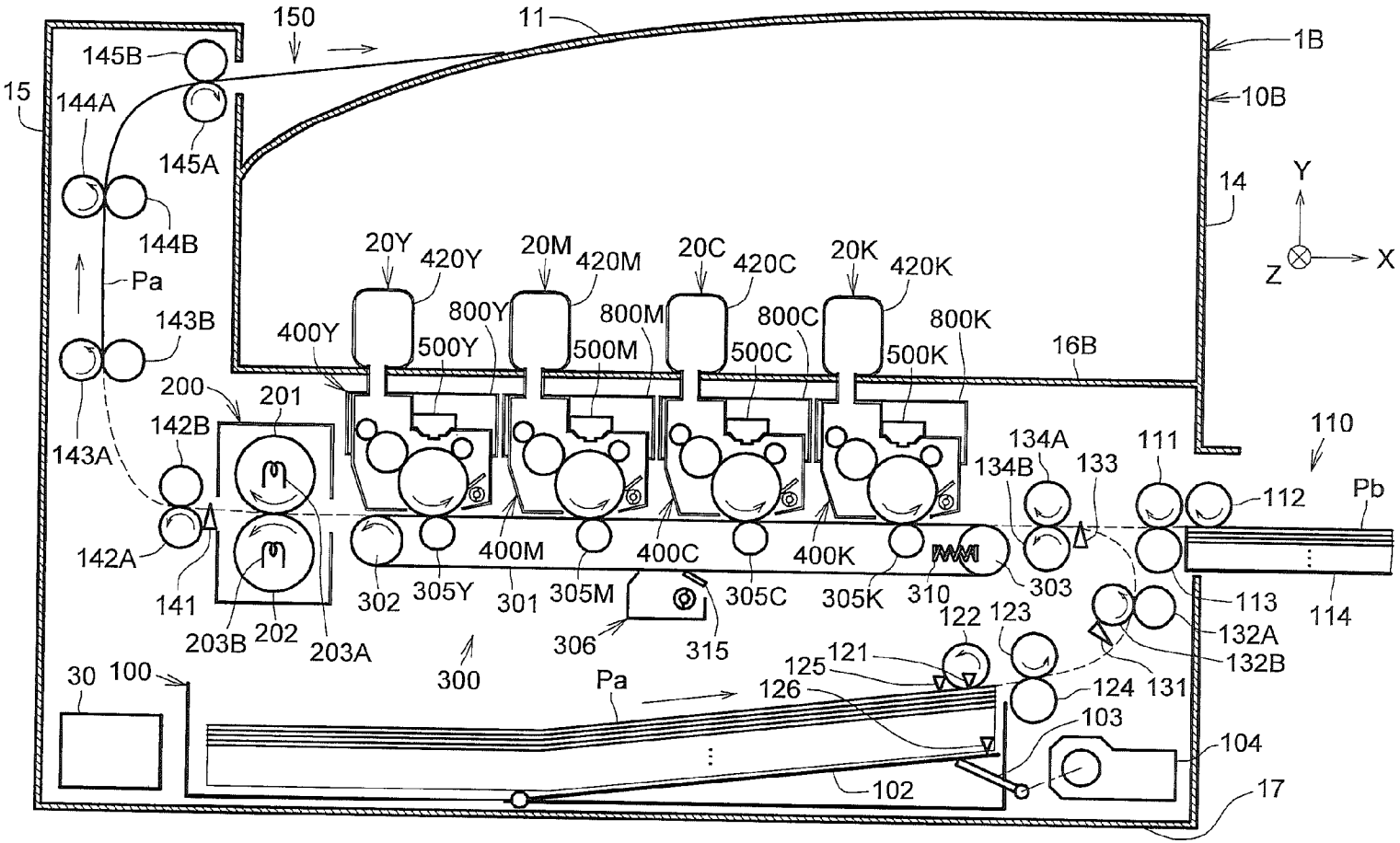
FIG. 27 is a schematic view showing a configuration of an image forming apparatus of a direct transfer type.

FIG. 27 is a schematic view showing a configuration of an image forming apparatus 1B using a direct transfer system. The image forming apparatus 1B shown in FIG. 27 is different from the image forming apparatus 1A shown in FIG. 1 in that the image forming apparatus 1B has a medium conveying mechanism 300 instead of the intermediate transfer belt unit 700 (FIG. 1). Further, the image forming apparatus 1B shown in FIG. 27 is different from the image forming apparatus 1A shown in FIG. 1 in a disposition of the top plate 16B. In other respects, the image forming apparatus 1B shown in FIG. 27 is substantially the same as the image forming apparatus 1A shown in FIG. 1. The developer storage portions 420K, 420C, 420M and 420Y are placed on the top plate 16B as a part of the apparatus main body (i.e., the frame) 10B.

The medium conveying mechanism 300 of the image forming apparatus 1B shown in FIG. 27 includes a conveying belt 301, a driving roller 302, a tension roller 303, a resilient member 310, transfer rollers 305K, 305C, 305M and 305Y, and a belt cleaning portion 306. The conveying belt (i.e., a medium conveying member) 301 is configured to convey the recording medium Pa (Pb) supplied by the conveying rollers 134A and 134B. The driving roller 302 drives the conveying belt 301. The tension roller 303 rotates following a rotation of the driving roller 302. The resilient member 310 resiliently biases the tension roller 303 in a predetermined direction. The transfer rollers 305K, 305C, 305M and 305Y are provided so as to face process units 400K, 400C, 400M and 400Y via the conveying belt 301. The driving roller 302, the tension roller 303 and the resilient member 310 constitute a driving mechanism for driving the conveying belt 301. The transfer rollers 305K, 305C, 305M and 305Y transfer the developer images from the photosensitive drums 401K, 401C, 401M and 401Y to the recording medium Pa (Pb) on the conveying belt 301. The conveying belt 301 conveys the recording medium Pa (Pb) to the fixing unit 200.

The belt cleaning portion 306 is configured to remove the developer remaining on the conveying belt 301 after the developer image is transferred to the recording medium Pa (Pb). The belt cleaning portion 306 has a cleaning member 315 contacting the surface of the conveying belt 301 with a constant pressure. The cleaning member 315 scrapes the developer from the conveying belt 301.

The image forming apparatus 1 of the first embodiment includes four image forming units 20K, 20C, 20M and 20Y to form a color image. However, the present invention is not limited to such a configuration. For example, the first and second mechanisms of the above described embodiment can be applied to an image forming apparatus having a single image forming unit configured to form a monochrome image.

The present invention is applicable to a copier, a facsimile machine, a printer and an MFP (Multi Function Peripheral) and the like.

While the preferred embodiments of the present invention have been illustrated in detail, it should be apparent that modifications and improvements may be made to the invention without departing from the spirit and scope of the invention as described in the following claims.

What is claimed is:

1. An image forming apparatus, comprising:

an apparatus main body;

a image forming unit that forms a developer image, the image forming unit comprising a first unit, a second unit detachably mounted to the apparatus main body, and a third unit;

a first mechanism that causes the second unit to move relatively toward and away from the first unit in only a substantially vertical direction;

a moving member that moves the first mechanism; and a second mechanism that causes the third unit to move relatively toward and away from the second unit in only the substantially vertical direction in conjunction with a movement of the first mechanism.

2. The image forming apparatus according to claim 1, wherein the moving member is provided in the apparatus main body so as to move between a first position and a second position, and wherein when the moving member moves from the first position toward the second position, the first mechanism causes the first unit and the second unit to move away from each other.

3. The image forming apparatus according to claim 1, wherein when the first mechanism causes the first unit and the second unit to move away from each other, the second mechanism causes the second unit and the third unit to move away from each other.

4. The image forming apparatus according to claim 1, further comprising a unit holding portion that holds the second unit.

5. The image forming apparatus according to claim 4, wherein the first mechanism causes the unit holding portion to move away from the first unit.

6. The image forming apparatus according to claim 4, wherein the second unit is detachably mounted to the unit holding portion.

7. The image forming apparatus according to claim 6, wherein the first mechanism comprises:

a beam member that supports the unit holding portion; and a linking member that links the beam member and an end of the moving member allowing movements of the beam member and the end of the moving member, wherein the linking member causes the second unit to move away from the first unit by causing the beam member to move in a predetermined direction in conjunction with a movement of the moving member.

8. The image forming apparatus according to claim 7, wherein the linking member comprises:

an arm member having an end portion rotatably connected to an end portion of the moving member;

a lever member rotatably connected to the other end portion of the arm member and rotatably connected to the beam member, wherein the lever member causes the beam member to move in the predetermined direction in conjunction with the movement of the moving member.

9. The image forming apparatus according to claim 8, wherein the first mechanism further comprises:

a driven lever member that rotatably engages the other end portion of the beam member; and a lever-linking member that links the lever member and the driven lever member and transmits a force from the lever member to the driven lever member, wherein the driven lever member causes the beam member to move in the predetermined direction in conjunction with the movement of the moving member.

10. The image forming apparatus according to claim 1, wherein when the first mechanism causes the first unit and the second unit to move away from each other, the second mechanism causes the second unit and the third unit to move away from each other and also causes the first unit and the third unit to move away from each other.

11. The image forming apparatus according to claim 10, wherein a distance between the first unit and the second unit in a state where the first unit and the second unit move farthest from each other is less than a distance between the first unit and the third unit in a state where the first unit and the third unit move farthest from each other.

12. The image forming apparatus according to claim 1, wherein when the first mechanism causes the second unit to move away from the first unit, the second mechanism causes the third unit to move away from the second unit.

13. The image forming apparatus according to claim 12, wherein the second mechanism causes the third unit to move away from the second unit, and also causes the third unit to move away from the first unit.

14. The image forming apparatus according to claim 1, further comprising an opening through which the second unit is detachably mounted to the apparatus main body.

15. An image forming apparatus, comprising:

an apparatus main body;

a image forming unit that forms a developer image, the image forming unit comprising a first unit, a second unit detachably mounted to the apparatus main body, and a third unit;

a first mechanism that causes the first unit and the second unit to move toward or away from each other, the first mechanism including a beam member that supports the second unit;

a moving member that moves the first mechanism;

a linking lever member that includes a rotation support portion disposed at an end portion of the linking lever member, a mounting hole connected to the third unit, and an engagement hole provided between the rotation support portion and the mounting hole, the engagement hole receiving a force applied by the beam member, and that causes the third unit and the first mechanism to move in conjunction with each other, the third unit being rotatably connected to the linking lever member; and a movement restriction member that restricts a movement of the end portion of the linking lever member relative to the apparatus main body, wherein when the first mechanism moves, the beam member of the first mechanism applies the force on the engagement hole and causes the linking lever member to rotate about the rotation support portion, and moves the second unit and the third unit toward or away from each other, and wherein a moving amount of the third unit is larger than a moving amount of the second unit.

16. The image forming apparatus according to claim 15, wherein the linking lever member causes the second unit and the third unit to move in a direction away from the first unit, and also causes the third unit to move away from the second unit in conjunction with the movement of the first mechanism.

17. The image forming apparatus according to claim 15, wherein the first unit is a transfer unit.

18. The image forming apparatus according to claim 15, wherein the second unit is a process unit including an image bearing body that bears a developer image.

19. The image forming apparatus according to claim 15, further comprising an image bearing body, wherein the third unit is an exposure unit provided so as to face the surface of the image bearing body, the exposure unit being configured to emit light to expose the surface of the image bearing body.

20. The image forming apparatus according to claim 15, further comprising an opening, wherein the moving member is a cover portion configured to open and close the opening.

* * * * *